US011007542B2

(12) United States Patent
Baaren

(10) Patent No.: US 11,007,542 B2
(45) Date of Patent: May 18, 2021

(54) CYCLONE SEPARATOR AND METHODS OF USING SAME

(71) Applicant: FMC Technologies, Inc., Houston, TX (US)

(72) Inventor: Sander Baaren, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 0 days.

(21) Appl. No.: 16/378,121

(22) Filed: Apr. 8, 2019

(65) Prior Publication Data

US 2020/0316618 A1 Oct. 8, 2020

(51) Int. Cl.

| | |
|---|---|
| ***B04C 5/30*** | (2006.01) |
| ***B04C 5/04*** | (2006.01) |
| ***B04C 5/081*** | (2006.01) |
| ***B04C 5/103*** | (2006.01) |
| ***B04C 5/02*** | (2006.01) |
| ***B04C 5/06*** | (2006.01) |
| ***B04C 3/00*** | (2006.01) |
| ***B04C 9/00*** | (2006.01) |
| ***B04C 5/13*** | (2006.01) |

(52) U.S. Cl.

CPC ..... *B04C 5/30* (2013.01); *B04C 5/04* (2013.01); *B04C 5/081* (2013.01); *B04C 5/103* (2013.01)

(58) Field of Classification Search

CPC ..... B04C 5/30; B04C 5/103; B04C 5/081; B04C 5/04; B04C 5/26; B04C 3/06; B04C 3/04; B04C 2003/006; B04C 2003/003; B04C 5/02; B04C 5/06; B04C 2009/008; B04C 5/13; B01D 17/0217; B01D 21/34; B01D 21/267; B01D 2221/04; C02F 1/38; C02F 2103/10

USPC ..... 210/787, 788, 789

See application file for complete search history.

(56) References Cited

U.S. PATENT DOCUMENTS 2,147,671 A * 2/1939 Pratt ..... B01D 45/16 55/410
2,918,139 A * 12/1959 Silverman ..... B04C 5/103 55/339

(Continued)

FOREIGN PATENT DOCUMENTS

EP 0346747 B1 9/1995
EP 1600215 A1 11/2005

(Continued)

OTHER PUBLICATIONS

Search Report and Written Opinion from PCT/US2020/024912 dated Jul. 20, 2020.

*Primary Examiner* — Nam X Nguyen
*Assistant Examiner* — Ekandra S. Miller-Cruz
(74) *Attorney, Agent, or Firm* — Osha Bergman Watanabe & Burton LLP

(57) ABSTRACT

One illustrative cyclone separator disclosed herein includes an outer body, an inner body positioned at least partially within the outer body, an internal flow path within the inner body, the internal flow path having a fluid entrance and a fluid outlet, a first fluid flow channel between the inner body and the outer body, and a re-entrant fluid opening that extends through the outer body and is in fluid communication with the fluid flow channel, wherein the re-entrant fluid opening is positioned at a location upstream of the fluid entrance of the internal flow path in the inner body.

21 Claims, 21 Drawing Sheets

(56) References Cited

U.S. PATENT DOCUMENTS 2,981,413 A 4/1961 Fitch
3,283,480 A * 11/1966 Szego ..... B04C 5/12 55/340
3,693,329 A * 9/1972 Willis ..... B01D 45/12 55/457
3,802,570 A * 4/1974 Dehne ..... B04C 5/14 210/304
4,622,150 A * 11/1986 Carroll ..... B01D 17/0214 210/739
6,202,576 B1 * 3/2001 Nagl ..... B04C 5/185 110/342
6,270,544 B1 * 8/2001 Mencher ..... B01D 45/16 55/318
6,752,845 B2 * 6/2004 Haland ..... B01D 45/16 55/340
7,846,343 B2 * 12/2010 Schook ..... B01D 19/0057 210/787
8,746,464 B2 * 6/2014 Maier ..... B04C 11/00 210/512.1
9,636,614 B2 5/2017 Akdim et al.
9,675,918 B2 6/2017 Loh et al.
2003/0159412 A1 * 8/2003 North ..... A47L 9/19 55/345
2008/0006011 A1 1/2008 Lamholm et al.
2009/0020467 A1 * 1/2009 Parkinson ..... B01D 21/2444 210/188
2009/0139938 A1 6/2009 Lamholm et al.
2010/0006516 A1 1/2010 Schook
2012/0227585 A1 * 9/2012 Akdim ..... B01D 19/0057 95/271

FOREIGN PATENT DOCUMENTS

WO 2007/129276 A2 11/2007
WO WO2017/190852 A1 * 5/2016

* cited by examiner

Fig. 7
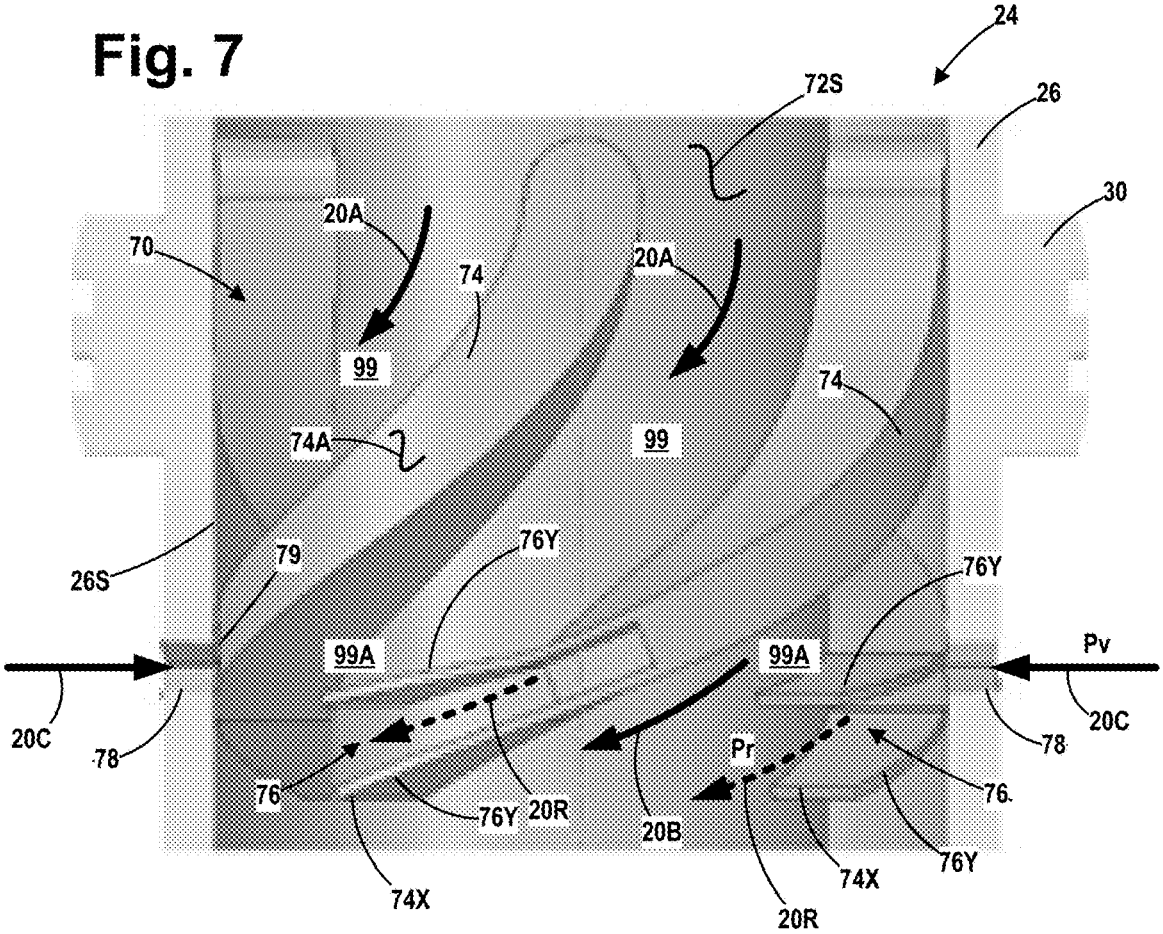
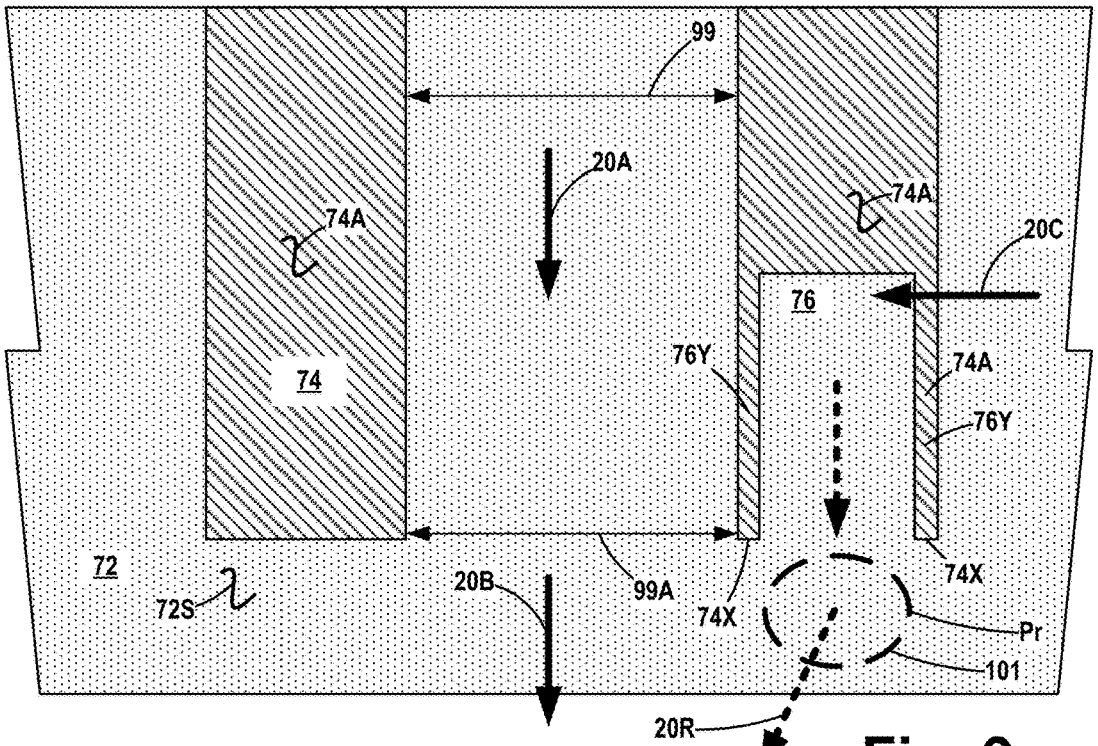
Fig. 9

CYCLONE SEPARATOR AND METHODS OF USING SAME

BACKGROUND

1. Field of the Disclosure

The present disclosure is generally directed to various novel embodiments of a cyclone separator and various methods of using such cyclone separators.

2. Description of the Related Art

Cyclone separators come in a variety of shapes and forms. For certain applications, a cyclone separator may be used to separate solids entrained in a fluid stream by inducing rotational flow of the fluid. Typically, such separators include a fluid inlet that is positioned tangentially with regards to a cylindrical body within which the fluid rotates. Another form of a cyclone separator comprises a rotational flow element (or a "swirl element") that is positioned within an outer body. The inner surface of the outer body may sometimes be referred to as the outer wall of the cyclone separator. In some applications, there is a bottom opening in the outer body (in which the flow rotation element is positioned) that may be in the form of a conical-shaped bottom outlet. Typically, the body, with the rotational flow element positioned therein, is positioned in a larger vessel. The conical-shaped bottom outlet simply discharges into an accumulation section of the vessel positioned below the cyclone separator.

Typically, the rotational flow element comprises a plurality of vanes. The vanes, in combination with the outer wall of the cyclone separator, define a spiral flow path (from an upstream direction to a downstream direction) between adjacent vanes through which the solid-containing fluid is forced. As the rotating fluid flows downward through the vanes, centrifugal forces acting on the rotating fluid cause some of the solid particles (and liquid if present) to be pushed toward the inner surface of the outer wall of the cyclone separator. Then, the rotating fluid is forced to change direction in order to flow towards the cyclone outlet. The entrained solid particles have more momentum compared to the fluid due to their higher density, which causes these solid particles to flow towards the bottom of the cyclone. From the bottom of the cyclone, the displaced solid particles are typically simply allowed to fall (due to gravity) into the accumulation section of the vessel. The accumulation section of the vessel has an opening in the bottom of the vessel that is closed off by a valve during normal operation. After a certain time period, or when a certain amount of solid particles have been collected in the accumulation section, the solid particles are removed from the accumulation section through the bottom outlet of the vessel. If there is enough differential pressure between the accumulation section and the location where the solids need to go, this can be done by opening the valve at the bottom of the accumulation section for a certain period of time until a sufficient amount of solid particles have been removed. In other cases where there is insufficient pressure differential, this can be done by using a certain "sweep" fluid, e.g., water. This sweep fluid can be introduced through additional connections in the top of the accumulation section, or through a pressurized system that introduces the sweep fluid at high velocity thus fluidizing the solid particles prior to opening the bottom valve.

The cyclone separator also typically includes what is referred to as a vortex finder. The vortex finder is simply a pipe or opening that has an entrance at some location downstream of the exit of the plurality of vanes. In operation, after the fluid passes through the vanes, where some of the solids are removed, relatively cleaner fluid passes through the entrance of the vortex finder where it ultimately flows out of the overall cleaned fluid outlet of the vessel.

Unfortunately, the formation of the conical-shaped bottom outlet in the outer body can lead to an undesirable accumulation of solid particles in the conical-shaped bottom outlet—below the flow rotation element—which may lead to some significant problems. The vessel in which the cyclone separator is positioned constitutes a closed system. Thus, the volume of solid particles that flow downwardly into the accumulation section below the conical-shaped bottom outlet is replaced by the volume of fluid flowing in an opposite direction, e.g., upward, back up through the conical-shaped bottom outlet toward the entrance to the vortex finder. Some of the accumulated particles at the conical-shaped bottom outlet are re-entrained in the upward fluid flow and flow upward within the separator, e.g., toward the entrance to the vortex finder. This process leads to a build-up of a quantity of the re-entrained solids at or near the entrance to the vortex finder, some of which may ultimately enter the vortex finder and be carried over to the cleaned fluid outlet of the vessel. This build-up of solids can also lead to enhanced erosion of the outer wall of the cyclone separator as these solid particles continuously hit the cyclone wall without being able to leave the cyclone due to the accumulation of solid particles at the conical-shaped bottom outlet.

Even in applications where the bottom outlet is not conical-shaped, the same problem described above with respect to an undesirable up-flow of the re-entrained particles can occur. That is, the volume of solid particles moving downward and entering the accumulation section of the vessel still expels an equal volume of fluid that has to flow in the opposite direction, e.g., upward. This adverse upward fluid flow makes it more difficult for the downward-moving solid particles to effectively enter the accumulation section and it also results in smaller solid particles being re-entrained in the upward fluid flow stream. The upward fluid flow carries the re-entrained particles towards the vortex finder where the re-entrained solid particles may undesirably be carried over to the cleaned fluid outlet of the vessel.

The present disclosure is therefore directed to various novel embodiments of a cyclone separator and various methods of using such cyclone separators that may eliminate or reduce one of more of the problems identified above.

SUMMARY OF THE DISCLOSURE

The following presents a simplified summary of the present disclosure in order to provide a basic understanding of some aspects disclosed herein. This summary is not an exhaustive overview of the disclosure, nor is it intended to identify key or critical elements of the subject matter disclosed here. Its sole purpose is to present some concepts in a simplified form as a prelude to the more detailed description that is discussed later.

The present disclosure is generally directed to various novel embodiments of a cyclone separator and various methods of using such cyclone separators. One illustrative cyclone separator disclosed herein includes an outer body, an inner body positioned at least partially within the outer body, an internal flow path within the inner body, the internal flow path having a fluid entrance and a fluid outlet, a first fluid flow channel between the inner body and the outer body, and a re-entrant fluid opening that extends through the outer body and is in fluid communication with the fluid flow channel, wherein the re-entrant fluid opening is positioned at a location upstream of the fluid entrance of the internal flow path in the inner body.

Another illustrative embodiment of a cyclone separator disclosed herein includes an outer body, a flow rotation element positioned at least partially within the outer body, the flow rotation element having first and second vanes, and a first fluid flow channel between the first and second vanes. In this embodiment, the separator also includes a first re-entrant fluid flow channel in at least one of the first and second vanes and a re-entrant fluid opening that is in fluid communication with the re-entrant fluid flow channel, wherein the re-entrant fluid opening extends through the outer body.

One illustrative method disclosed for separating a fluid stream in a cyclone separator that has an outer body and an inner body includes flowing the fluid stream though an incoming fluid inlet of the separator, through a first fluid flow channel in the separator and out of a fluid exit of the outer body of the separator, and re-introducing a portion of the fluid exiting the fluid exit of the outer body into the fluid stream at a location that is upstream of a fluid entrance to an internal flow path in the inner body.

BRIEF DESCRIPTION OF THE DRAWINGS

The disclosure may be understood by reference to the following description taken in conjunction with the accompanying drawings, in which like reference numerals identify like elements, and in which:

FIGS. 1-33 are various views of various illustrative examples of the novel cyclone separators disclosed herein and various methods of using such cyclone separators.

Figure 1:
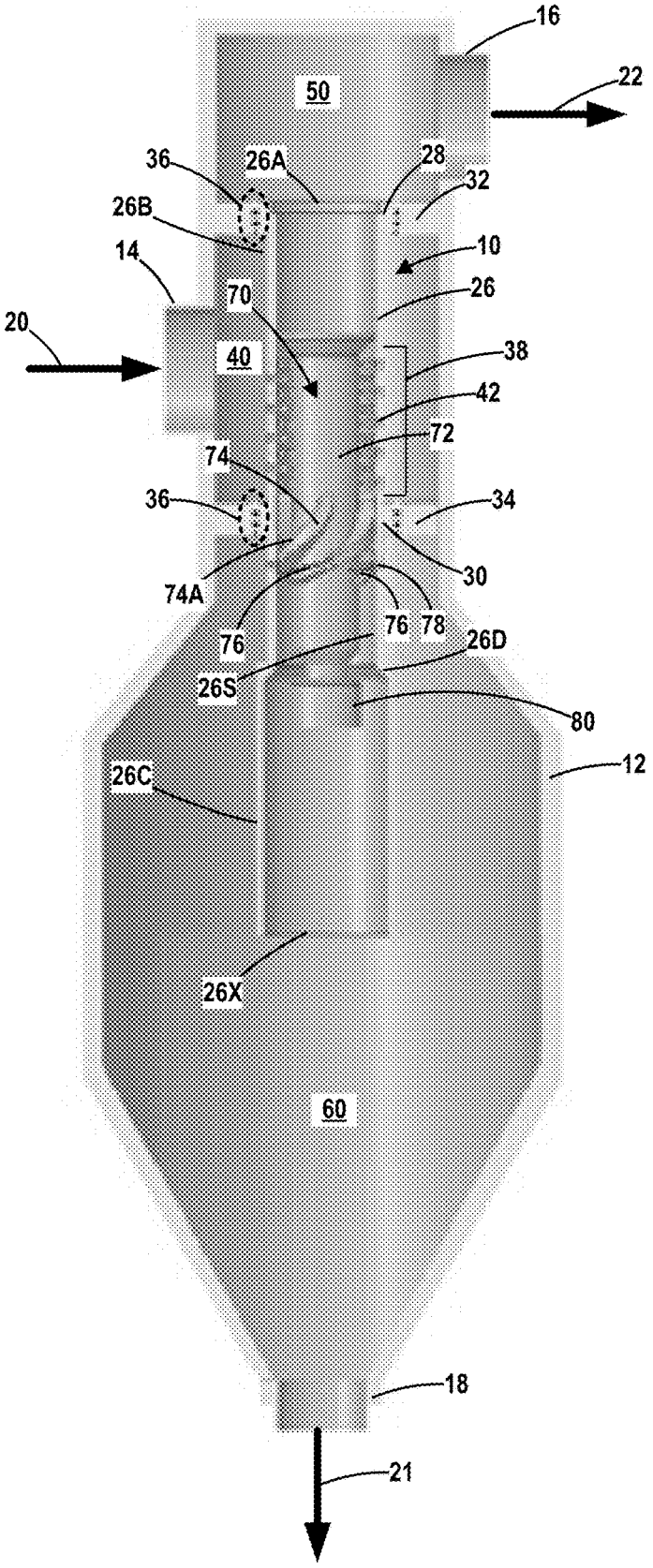

While the subject matter disclosed herein is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention.

DETAILED DESCRIPTION

Various illustrative embodiments of the present subject matter are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. Various systems, structures and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

In the following detailed description, various details may be set forth in order to provide a thorough understanding of the various exemplary embodiments disclosed herein. However, it will be clear to one skilled in the art that some illustrative embodiments of the invention may be practiced without some or all of such various disclosed details. Furthermore, features and/or processes that are well known in the art may not be described in full detail so as not to unnecessarily obscure the disclosure of the present subject matter. In addition, like or identical reference numerals may be used to identify common or similar elements.

FIGS. 1-33 are various views of various illustrative examples of the novel cyclone separators disclosed herein and various methods of using such cyclone separators. FIG. 1 is a cross-sectional view of one illustrative embodiment of a cyclone separator 10 disclosed. In general, this illustrative example of the separator 10 is positioned within a vessel 12 that comprises a fluid inlet 14, a fluid outlet 16, a solids outlet 18, a fluid inlet chamber 40, a fluid outlet chamber 50 and a solids accumulation chamber 60. Also schematically depicted in FIG. 1 is the incoming fluid 20 introduced via the fluid inlet 14, the outgoing processed or cleaned fluid 22 exiting the vessel 12 via the fluid outlet 16 and solids 21 that exit the vessel 12 via the solids outlet 18. In general, the incoming fluid 20 will include some amount of entrained solid particulate matter (not shown). Of course, the various embodiments of the separator 10 disclosed herein may be manufactured using a variety of techniques and a variety of different materials.

One illustrative purpose of the various embodiments of the separator 10 disclosed herein is to remove at least some of the entrained solid particulate matter in the incoming fluid 20 such that the cleaned fluid 22 exiting the vessel via the fluid outlet 16 contains a lesser amount of the solids than was present in the incoming fluid 20. The incoming fluid 20 may be comprised of one or more fluids (e.g., it may be a multiphase stream that comprises one or more liquids and/or gases) and it may include any amount or quantity of entrained solid particulate matter. Moreover, the entrained solid materials (not shown) may be comprised of various different particle sizes, and they may contain particulate material made of different materials. In one illustrative example, the incoming fluid 20 may be fluid received from an oil and gas well. In general, the incoming fluid 20 may have a gas-to-liquid ratio that ranges (inclusively) from 0% (i.e., no gas) to 100% (i.e., no liquid). In one particular example, the incoming fluid may have a relatively high gas-to-liquid ratio, e.g., at least 80-90% of the volume of the incoming fluid comprises gas. The temperature and/or pressure of the incoming fluid 20 may also vary depending upon the particular application. Because a certain amount of energy is dissipated within the cyclone separator10, the pressure of the incoming fluid 20 at the inlet 14 is always higher compared to the pressure of the cleaned fluid 22 that exits the vessel 12 via the fluid outlet 16. In some applications, the incoming fluid 20 may contain one or more liquids that are saturated with dissolved gas and/or are at or near their boiling point at the specific temperature and pressure. If this is the case, the induced pressure drop across the cyclone separator 10 will cause some of the dissolved gas to come out of solution for these liquids and/or a phase change of liquid itself may take place. Consequently, the volumetric gas-to-liquid ratio of the incoming fluid 20 may be higher or lower as compared to the gas-to-liquid ratio of the cleaned fluid 22.

With continuing reference to FIG. 1, this illustrative example of the cyclone separator 10 comprises an outer body 26 that comprise an upper flange 28 and a lower flange 30. The vessel 12 comprises a vessel upper flange 32 and a vessel lower flange 34. The cyclone separator 10 is adapted to be removably coupled within the vessel 12 by the engagement between the upper flange 28 and the lower flange 30 with, respectively, the upper flange 32 and the lower flange 34 of the vessel 12. A plurality of seals 36 (within the dashed line regions) may be positioned between the engaging flanges 28/32 and 30/34 so as to provide a fluid-tight seal between the fluid inlet chamber 40 and the fluid outlet chamber 50 as well as a fluid-tight seal between the fluid inlet chamber 40 and the solids accumulation chamber 60.

Figure 2:
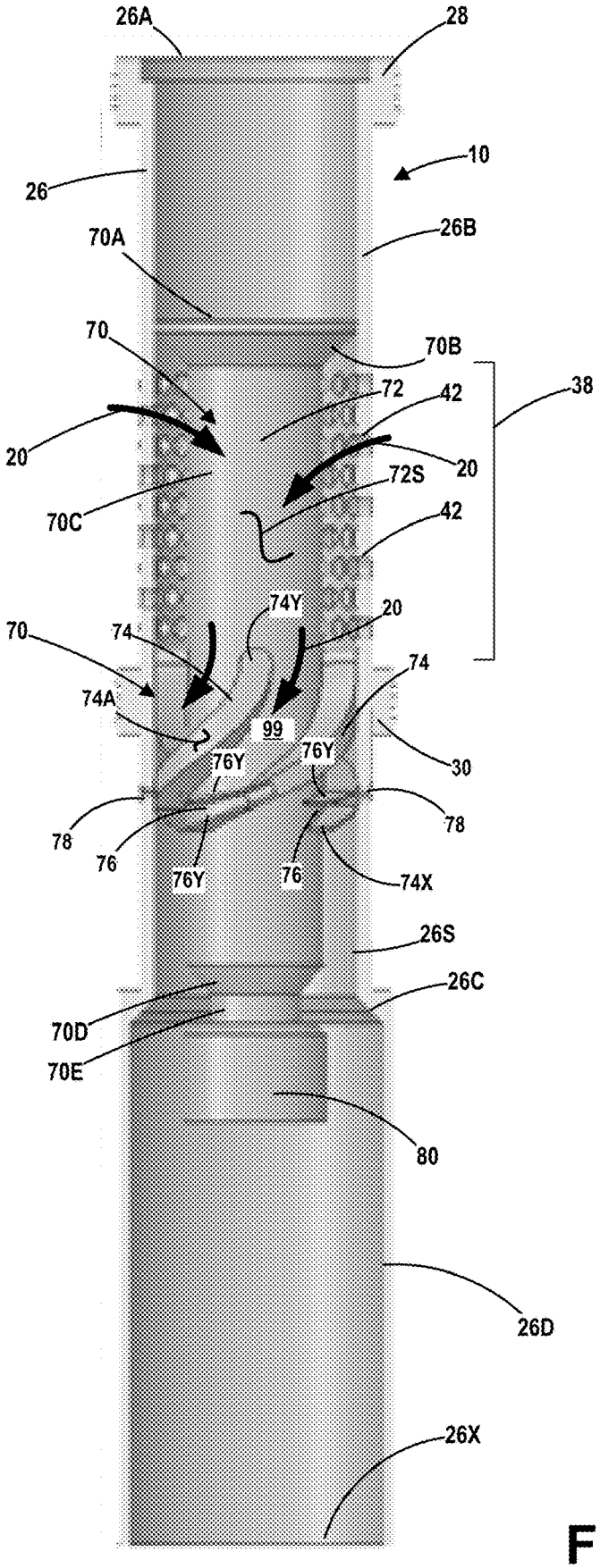

FIG. 2 is an enlarged cross-sectional view of one illustrative embodiment of a cyclone separator 10 disclosed herein. As reflected in FIGS. 1 and 2, the cyclone separator 10 comprises an outer body 26 with an internal surface 26S, an inner body 72 with an outer surface 72S and a flow rotation element 70. The flow rotation element 70 is sealingly positioned between the inner surface 26S of the outer body 26 and the outer surface 72S of the inner body 72. The internal surface 26S of the outer body 26 may be referred to as the outer wall of the cyclone separator 10. The cyclone separator 10 also comprises a cleaned fluid outlet 26A, an upper section 26B, a lower section 26D, a transition section 26C positioned between the upper section 26B and the lower section 26D and a bottom outlet 26X that discharges into the solids accumulation chamber 60.

The inner body 72 may have a variety of configurations. In one illustrative embodiment, the inner body 72 comprises a cleaned fluid outlet 70A, an upper cylindrical section 70C, a transition section 70B between the fluid outlet 70A and the upper cylindrical section 70C, a lower cylindrical section 70E and a transition section 70D between the upper cylindrical section 70C and the lower cylindrical section 70E. The upper cylindrical section 70C of the inner body 72 comprises an outer surface 72S.

As shown in FIGS. 1 and 2, the cyclone separator 10 includes a fluid inlet section 38 that comprises a plurality of openings 42 that extend through the outer body 26 so as to permit the flow of fluid 20 from the fluid inlet 14 into the fluid inlet chamber 40 and thereafter into the annular space between the outer surface 72S of the inner body 72 and the outer wall 26S (i.e., the internal surface) of the outer body 26 of the cyclone separator 10. The number, shape, size, configuration and placement of the openings 42 may vary depending upon the particular application. The openings 42 need not all be the same size and/or shape, but that may the case in some applications.

Figure 3:
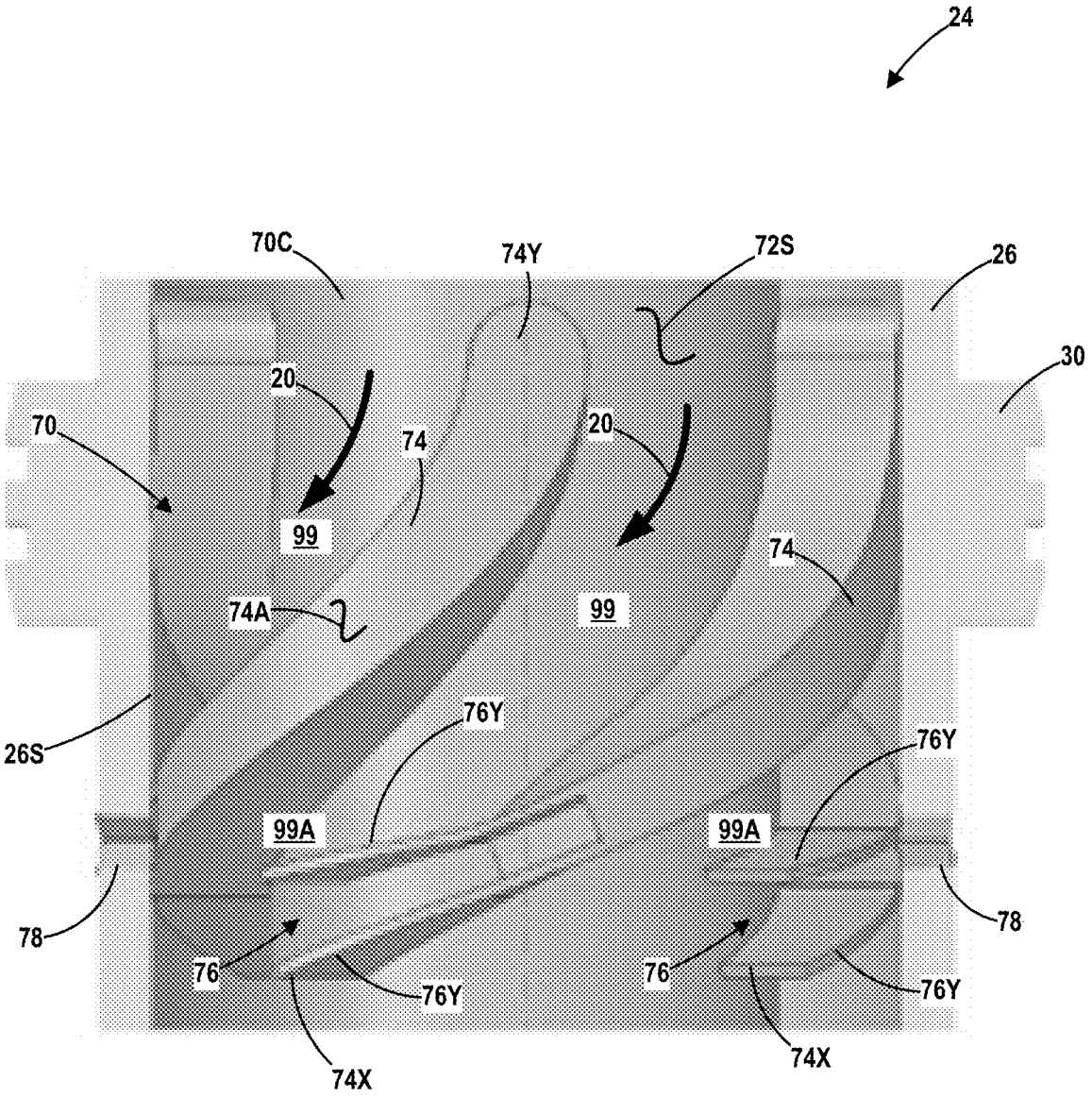

The flow rotation element 70 may have a variety of configurations. In one illustrative embodiment, the flow rotation element 70 comprises a plurality of spiraled vanes 74 positioned on or extending from the outer surface 72S of the cylindrical section 70C of the inner body 72. FIG. 3 is an enlarged view of the portion of the cyclone separator 10 that includes the vanes 74. The vanes have an upstream end 74Y and a downstream end 74X. The number, size and configuration of the vanes 74 may vary depending upon the particular application. In general, and as discussed more fully below, the vanes 74, in combination with other structures and components of the separator 10, are adapted to promote rotational movement of the fluid 20 as it flows downward through the vanes 74. Each of the vanes 74 comprises sidewalls and an outer surface 74A. In one illustrative embodiment, the outer surfaces 74A of the vanes 74 are adapted to substantially sealingly engage the outer wall 26S of the outer body 26 of the cyclone separator 10, thereby defining a nominal vane fluid flow path 99 between each pair of adjacent vanes 74.

Figure 4:
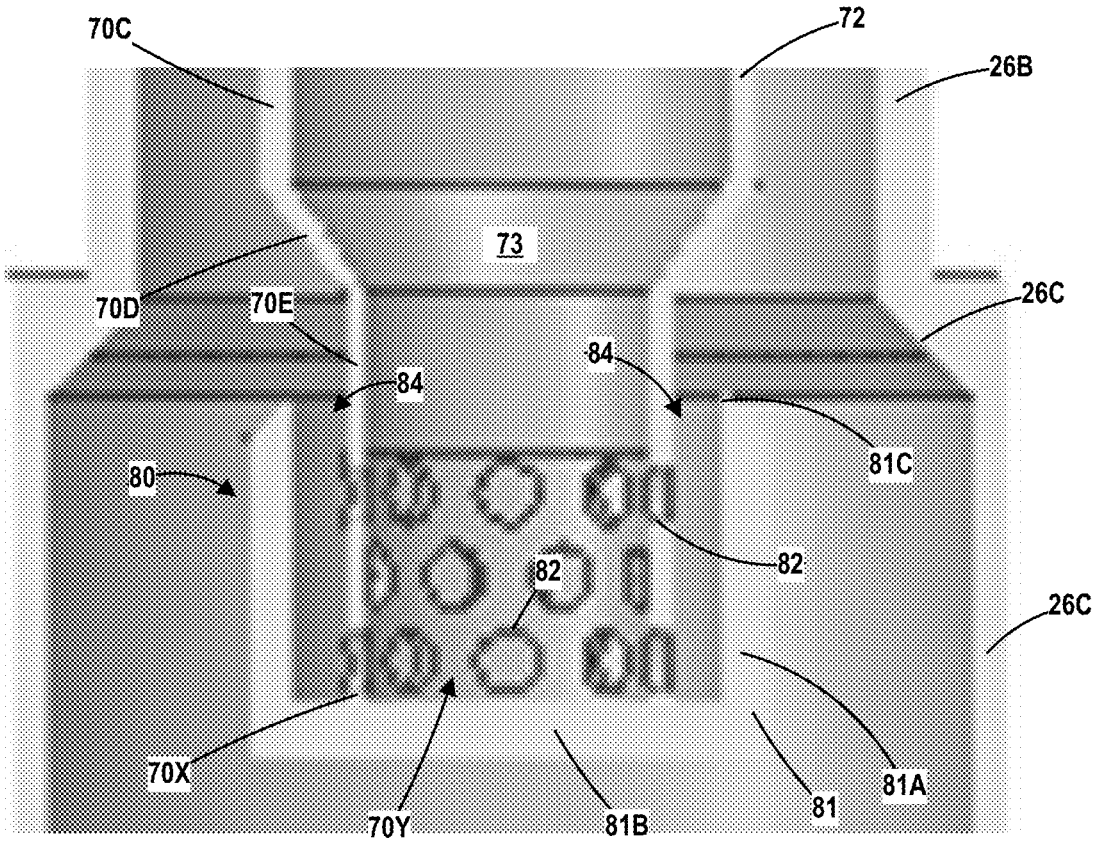
Figure 5:
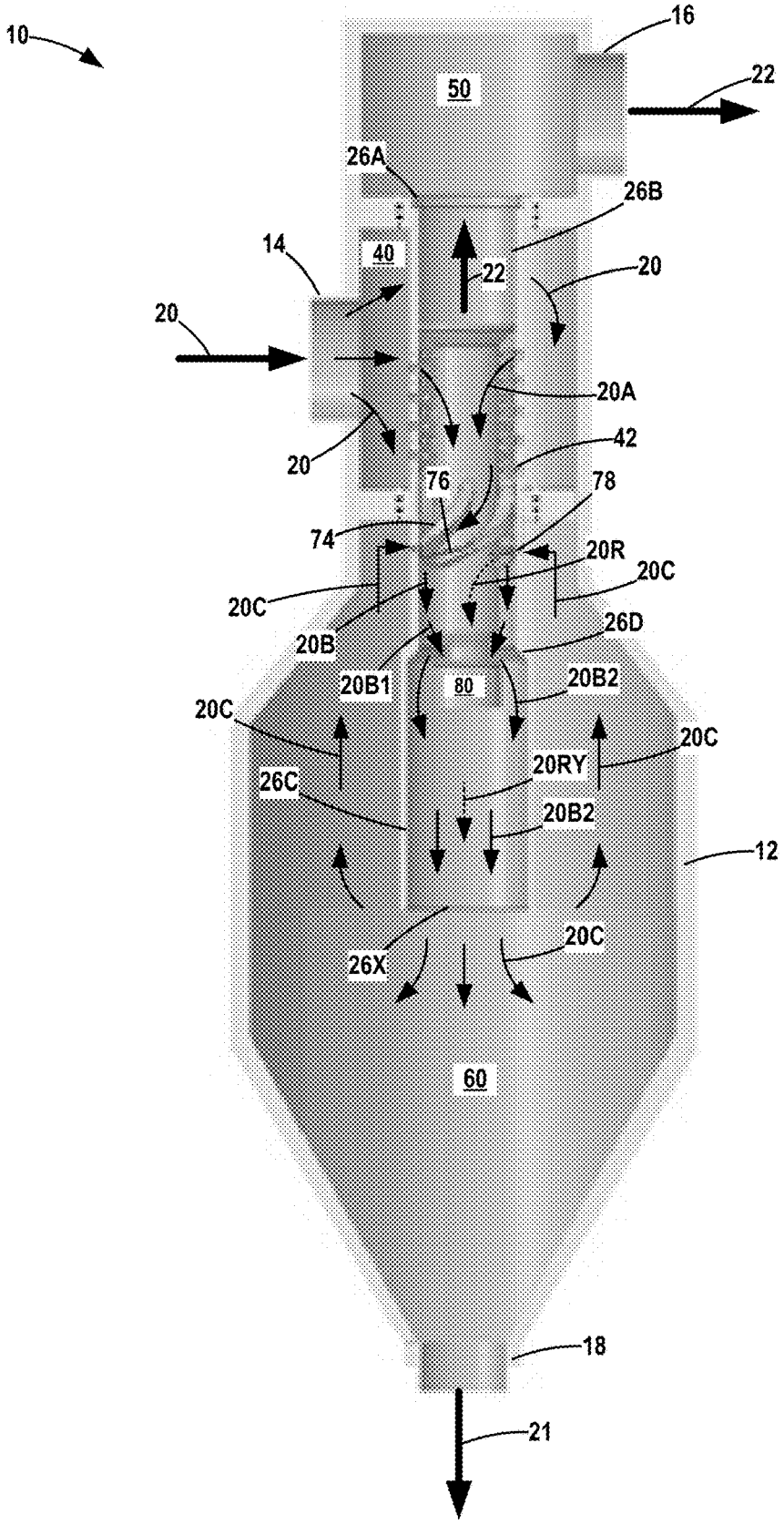
Figure 6:
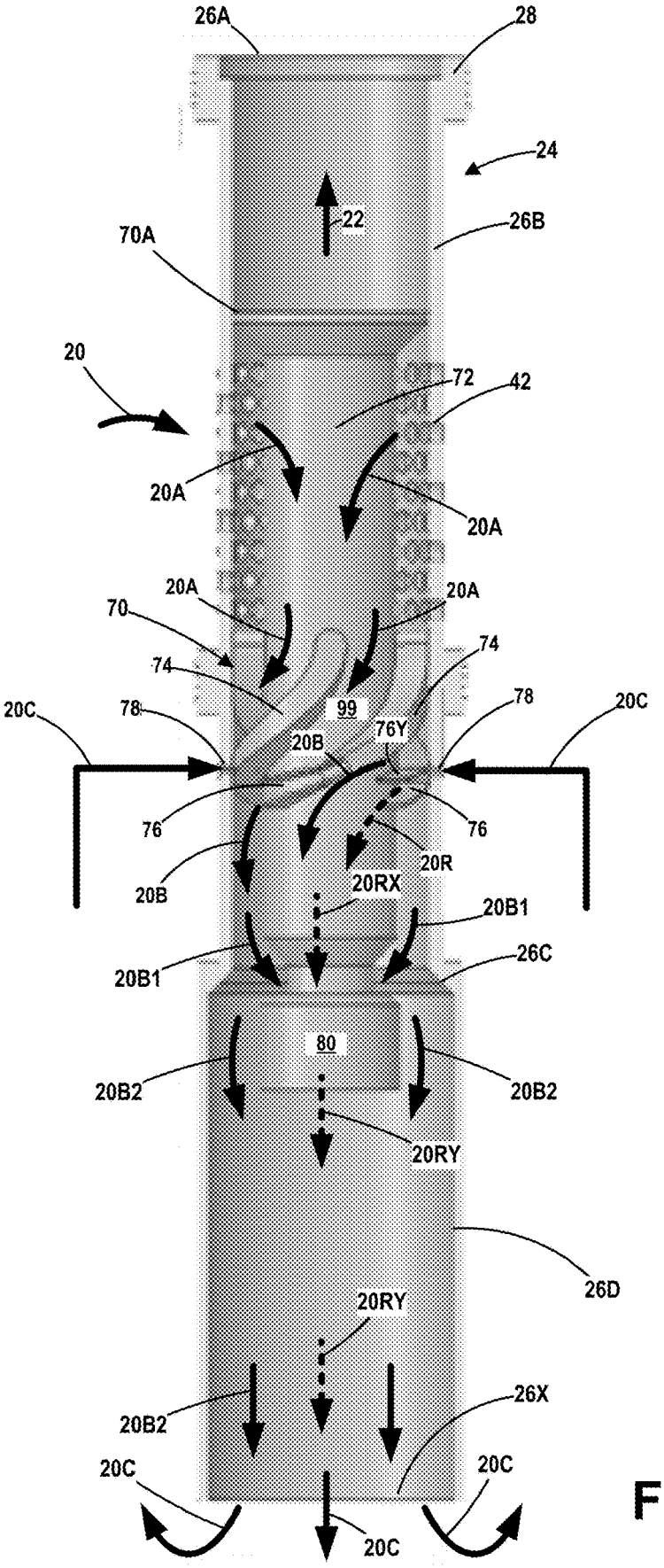

As shown in FIGS. 1 and 2, a return flow assembly 80 is operatively coupled to the lower end 70X of the inner body 72. FIG. 4 is an enlarged view of the return flow assembly 80. As described more fully below, the return flow assembly 80 provides a means by which a portion of the fluid 20 that has passed through the vanes 74 is redirected to a fluid flow entrance 70Y that is in fluid communication with an internal flow path 73 (see FIG. 4) inside of the inner body 72. Fluid that enters the fluid flow entrance 70Y flows through the internal flow path 73, out of the cleaned fluid outlet 70A and into the fluid outlet chamber 50 of the vessel 12 where it ultimately leaves the vessel via the fluid outlet 16. With continuing reference to FIG. 4, in one illustrative embodiment, the return flow assembly 80 comprises a body 81 comprised of a generally cylindrical portion 81A, a closed bottom 81B and an upper opening 81C The body 81 may be operatively coupled to the end of the inner body 72 by any desired means, e.g., the body 81 may be welded to a lowermost end 70X of the lower cylindrical section 70E of the inner body 72. The opening 81C of the body 81 is sized such that its internal diameter is greater than the external diameter of the lower cylindrical section 70E of the inner body 72 so as to thereby form a continuous ring-shaped opening 84 around the outer perimeter of the lower cylindrical section 70E. The opening 84 is adapted to receive a portion of the fluid 20 that has passed though the vanes 74 as well as a portion of a re-entrant fluid 20R (described more fully below). In this illustrative embodiment, the fluid flow entrance 70Y comprises a plurality of openings 82 formed in the lower cylindrical section 70E of the inner body 72. The number, shape, size, configuration and placement of the openings 82 may vary depending upon the particular application. The openings 82 need not all be the same size and/or shape, but that may the case in some applications. Of course, as will be appreciated by those skilled in the art after a complete reading of the present application, the subject matter disclosed is not limited to the use of the illustrative return flow assembly 80 depicted herein. As noted above, the purpose of the return flow assembly 80 is to re-direct a portion of the fluid that has passed through the vanes 74 to the cleaned fluid outlet 70A and into the internal flow path 73 inside of the inner body 72, where it will ultimately flow out of the fluid outlet 16 of the vessel 12. However, other means or mechanisms for accomplishing functions provided by the return flow assembly 80 are well known to those skilled in the art. For example, FIGS. 27-30 discussed below provide at least some other potential configurations whereby at least some of the fluid that has passed through the vanes 74 may enter the entrance 70Y to the internal flow path 73 in the inner body 72.

With continuing reference to FIGS. 2 and 3, in one illustrative example, each of the vanes 74 comprises a re-entrant fluid flow channel 76 located adjacent the downstream end 74X of the vane 74. As depicted, the downstream end 74X of the vanes 74 coincides with the downstream end of the re-entrant fluid flow channel 76. In the example shown in FIGS. 1-3, the re-entrant fluid flow channel 76 is at least partially defined by a plurality of vane sidewalls 76Y (with the outer surface 74A), the outer surface 72S of the cylindrical section 70C of the inner body 72 and the outer wall 26S of the outer body 26 of the cyclone separator 10. The outer surface 74A of the vane sidewalls 76Y engages the outer wall 26S. Each of the vane sidewalls 76Y comprises an interior surface (that faces the re-entrant fluid flow channel 76, and an exterior surface (that faces the nearest sidewall of an adjacent vane). The overall size and configuration of the re-entrant fluid flow channel 76 may vary depending upon the particular application. In some applications, all of the re-entrant fluid flow channels 76 on each of the vanes may be of the same size and configuration, although that may not be the case in some applications. Additionally, the axial length of the re-entrant fluid flow channel 76 (along the curvature of the vane 74) may vary depending upon the particular application. In some applications, a re-entrant fluid flow channel 76 may not be formed on all of the vanes 74.

Each of the re-entrant fluid flow channels 76 is in fluid communication with one of a plurality of re-entrant fluid openings 78 that extend through the outer body 26 of the cyclone separator 10. As depicted, each re-entrant fluid opening 78 provides a fluid flow path between the solids accumulation chamber 60 and one of the re-entrant fluid flow channels 76. With reference to FIG. 3, as noted above, a nominal vane fluid flow path 99 is defined between adjacent vanes 74. In some applications, the size (e.g., cross-sectional area) of the nominal vane flow path 99 at points or locations upstream of the re-entrant fluid openings 78 may be substantially constant and the size may vary depending upon the particular application. At the downstream end 74X of the re-entrant fluid flow channel 76, a vane exit fluid flow path 99A is defined between the exterior surface of one of the vane sidewalls 76Y of the re-entrant fluid flow channel 76 and the outer surface of the vane sidewall of the adjacent vane 74. As depicted, in one illustrative embodiment, the vane exit flow path 99A is substantially coterminous with the downstream end 74X of the vane 74. The size (e.g., cross-sectional area) of the vane exit flow path 99A may vary depending upon the particular application. Additionally, the size of the exit nominal vane flow path 99A may be the same as or different from the size of the nominal vane fluid flow path 99 upstream of the re-entrant fluid openings 78. In one illustrative embodiment, the size of the vane exit flow path 99A may be smaller than the size of the nominal vane fluid flow path 99 so as to increase the velocity of the fluid 20 as it exits the vane exit flow path 99A.

With reference to FIGS. 5-8, the path of fluid flow through this illustrative example of the separator 10 will now be explained. FIGS. 27-30 provide some possible alternative configurations of the lower end of the inner body 72 so as to permit fluid to enter into the internal flow path 73. Incoming fluid 20, with entrained solids therein, enters the vessel 12 via the fluid inlet 14 where it flows into the annular fluid inlet chamber 40 between the inner surface of the vessel 12 and the outside surface of the upper section 26B of the outer body 26 of the cyclone separator 10. As the initial fluid 20 passes through the openings 42 in the outer body 26, relatively large entrained particles in the entering fluid 20 will be filtered out and fall to the bottom of the fluid inlet chamber 40 where they can later be manually removed. At that point, a relatively cleaner fluid stream—now referenced using the numeral 20A—enters into the annular space between the outer wall 26S and the outer surface 72S of the inner body 72. This stream of fluid 20A now enters the vanes 74 wherein the velocity of the fluid 20A is increased as the fluid 20A is forced to flow downward through the spiraling flow paths between the vanes 74. During this process, solid particulate matter and liquid in the fluid 20A is forced radially outward against the outer wall 26S of the cyclone separator 10. These expelled solid particles and fluids fall out though the bottom 26X of the cyclone separator 10 and into the solids accumulation chamber 60.

At that point, a now relatively cleaner fluid—now referenced using the numeral 20B—exits the vanes 74. The fluid 20B travels further downward within the cyclone separator 10 until such time as a first portion 20B1 of the fluid 20B enters into the return flow assembly 80 (via the continuous opening 84). A second portion 20B2 of the fluid 20B bypasses the return flow assembly 80 and flows out of the bottom 26X of the cyclone separator 10 and into the solids accumulation chamber 60. All of the fluids exiting the bottom 26X of the cyclone separator 10 and flowing into the solids accumulation chamber 60 are referenced using the designation 20C.

FIGS. 7 and 9 will be referenced to explain at least some operational aspects of the illustrative separator 10 depicted herein. FIG. 9 is a simplistic plan view that schematically depicts two adjacent vanes 74 with an illustrative re-entrant fluid flow channel 76 formed in the vane 74 on the right. The outermost surfaces 74A of the vanes 74 and the sidewalls 76Y of the re-entrant fluid flow channel 76 are shown in FIG. 9. The surfaces 74A are positioned against the outer wall 26S of the cyclone separator 10. In this example, the re-entrant fluid flow channel 76 is formed such that the outer surface 72S of the inner body 72 is exposed at the bottom of the re-entrant fluid flow channel 76. Also shown in FIG. 9 is the nominal vane flow path 99 between the vanes 74 at a point or location upstream of the re-entrant fluid openings 78. The vane exit flow path 99A at a location proximate the downstream end 74X of the vane 74/re-entrant fluid flow channel 76 is also depicted in FIG. 9. In this particular example, the flow paths 99, 99A are approximately the same size, e.g., they have approximately the same width. In general, as the fluid 20A exits the vanes 74, it will create a simplistically depicted low-pressure zone 101 (indicated by the dashed-line region) downstream of the exit of the re-entrant fluid flow channel 76. The pressure (Pr) at this localized low-pressure zone 101 at the end of the re-entrant fluid flow channel 76 is less than the pressure (Pv) within the solids accumulation chamber 60 of the vessel 12 and outside of the portion of the outer body 26 that is positioned within the solids accumulation chamber 60. As a result of this differential pressure, a portion of the fluid 20C within the solids accumulation chamber 60 will flow through a re-entrant fluid opening 78 (that extends through the outer body 26 of the cyclone separator 10) and into the depicted re-entrant fluid flow channel 76. This re-entrant fluid is designated with the dashed line arrow labeled 20R at a point where it exits the re-entrant fluid flow channel 76. Note that the re-entrant fluid opening 78 is adapted to receive a fluid that previously passed through the exit flow paths 99A between the plurality of vanes 74.

Figure 8:
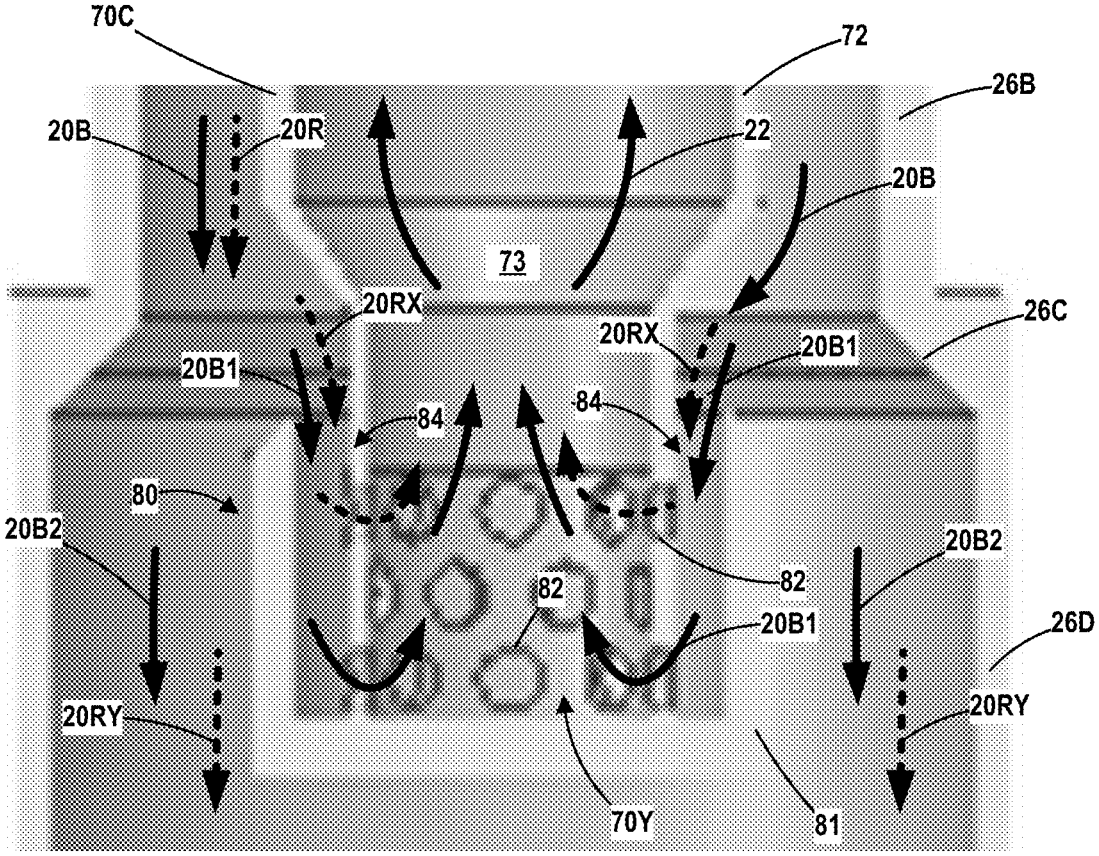

With continued reference to FIGS. 5-8, as the re-entrant fluid 20R exits the re-entrant fluid flow channel 76, it will travel further downward within the cyclone separator 10 until such time as a first portion 20RX (see FIG. 8) of the re-entrant fluid 20R enters into the return flow assembly 80 (via the continuous opening 84). A second portion 20RY of the re-entrant fluid 20R bypasses the return flow assembly 80 and flows out of the bottom 26X of the cyclone separator 10 and into the solids accumulation chamber 60. As noted above, all of the fluid exiting the bottom 26X of the cyclone separator 10, including the second portion 2ORY of the re-entrant fluid 20R that flows into the solids accumulation chamber 60, is referenced using the designation 20C. As noted above, a portion of the fluid 20C flows upward in the annular space between the vessel 12 and the portion of the outer body 26 that is positioned within the solids accumulation chamber 60, wherein it is introduced into the re-entrant fluid flow channel 76 via the re-entrant fluid opening 78. With reference to FIG. 8, the fluid streams 20B1 and 20RX pass through the openings 82 in the cyclone separator 10 where they combine to form the cleaned fluid stream 22 that flows out of the fluid outlet 70A of the inner body 72, into the fluid outlet chamber 50 and ultimately exits the vessel 12 via the fluid outlet 16. Any solids 21 that fall to the bottom of the solids accumulation chamber 60 may be removed via the solids outlet 18.

Figure 27:
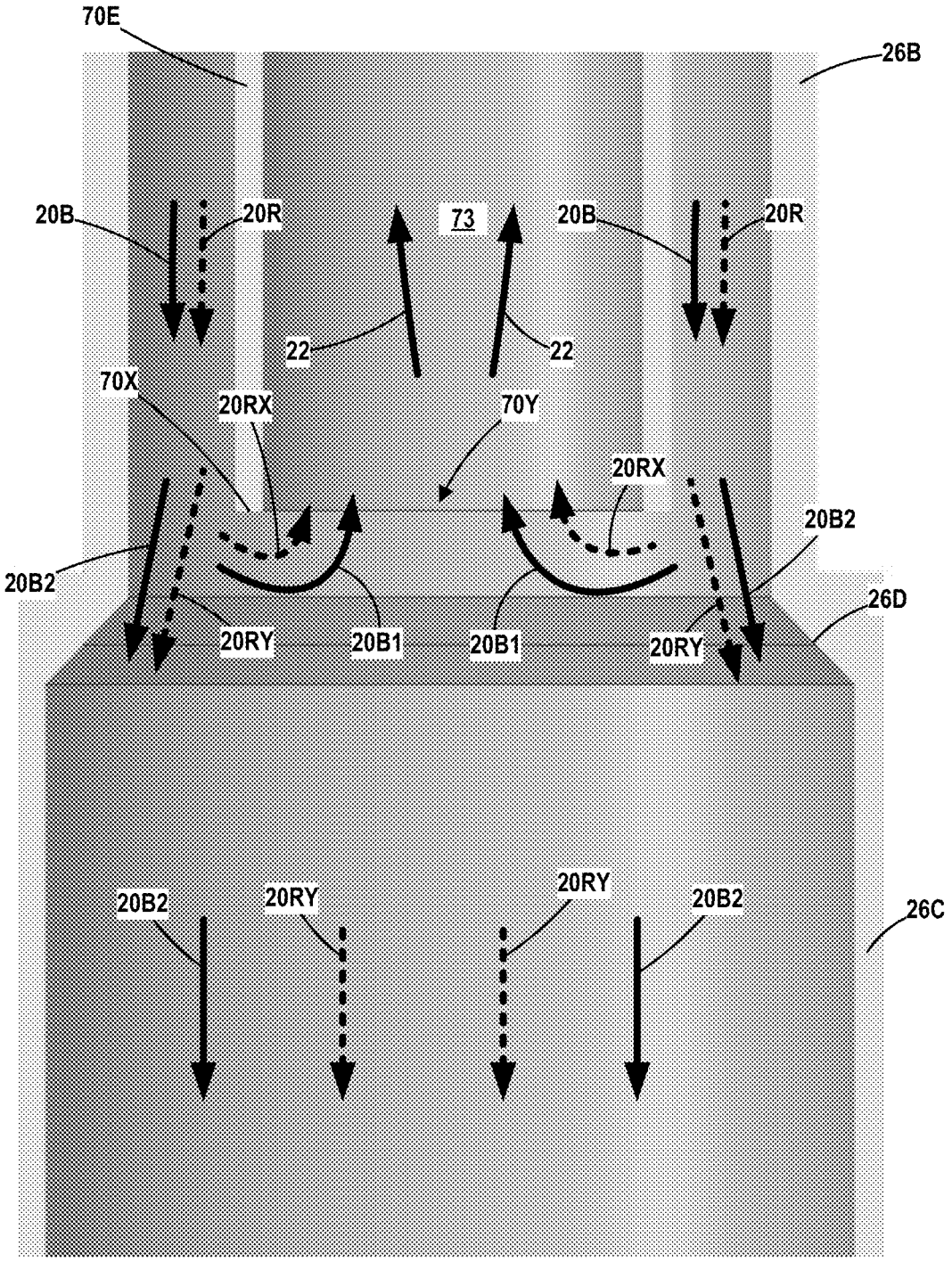
Figure 28:
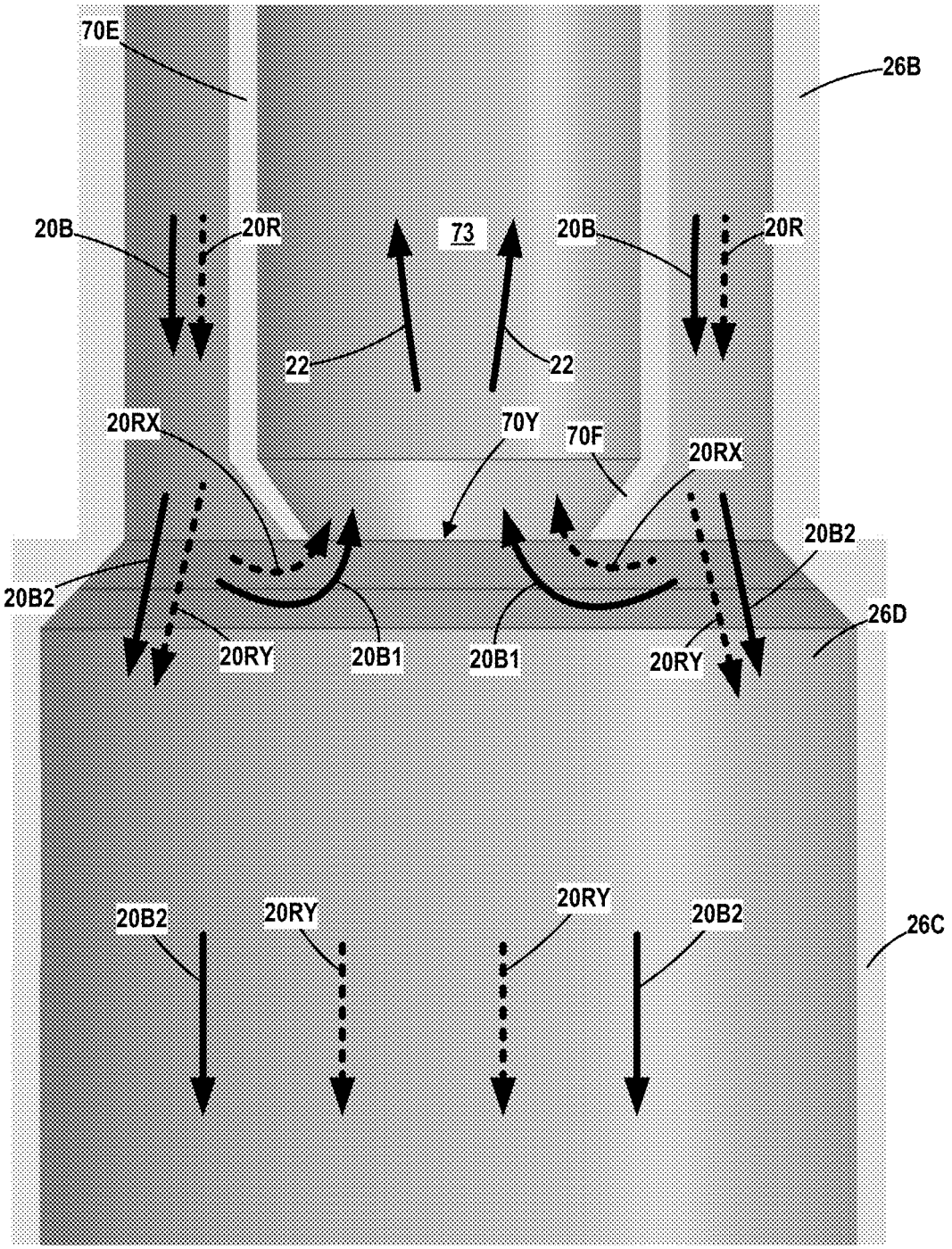
Figure 29:
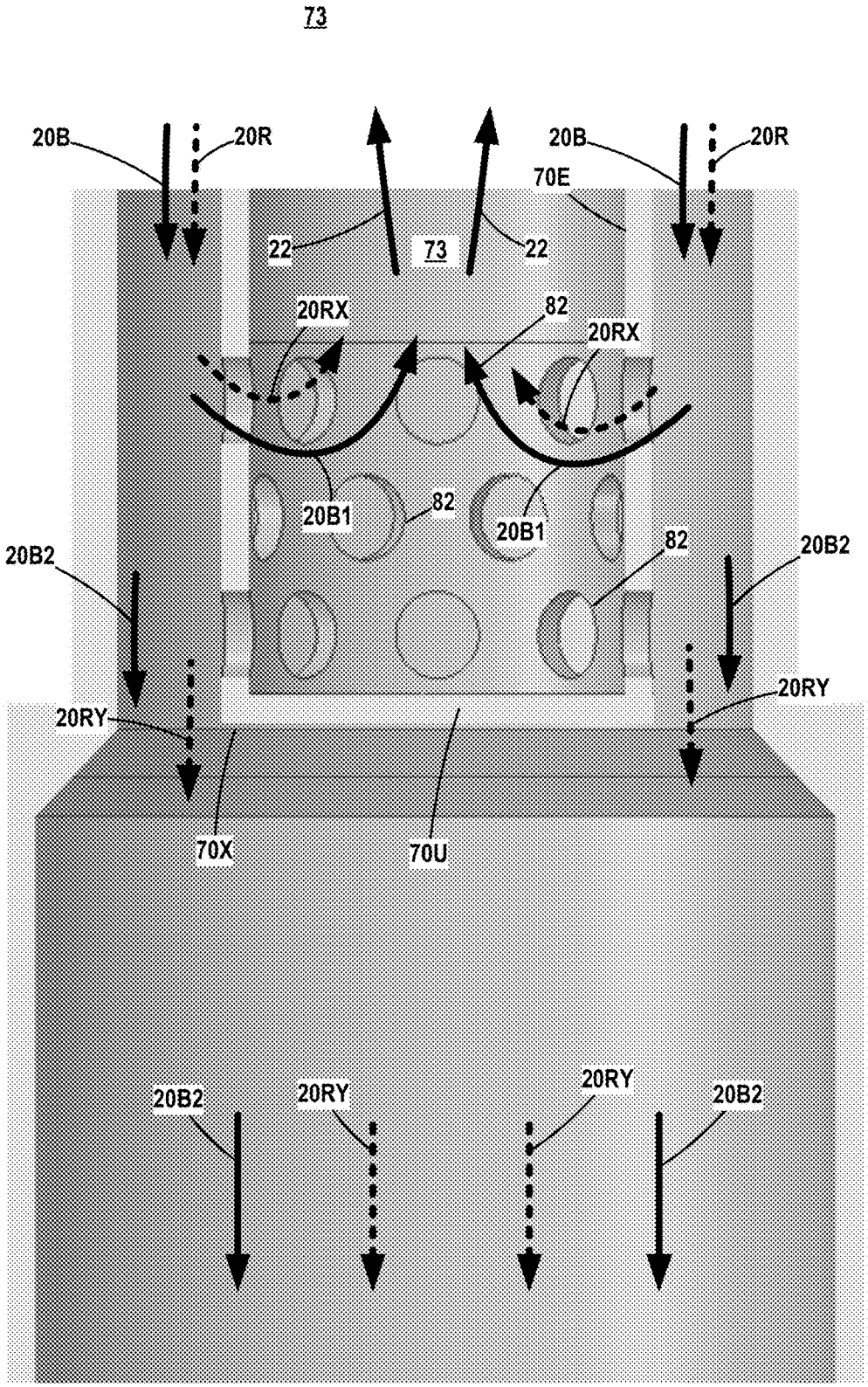
Figure 30:
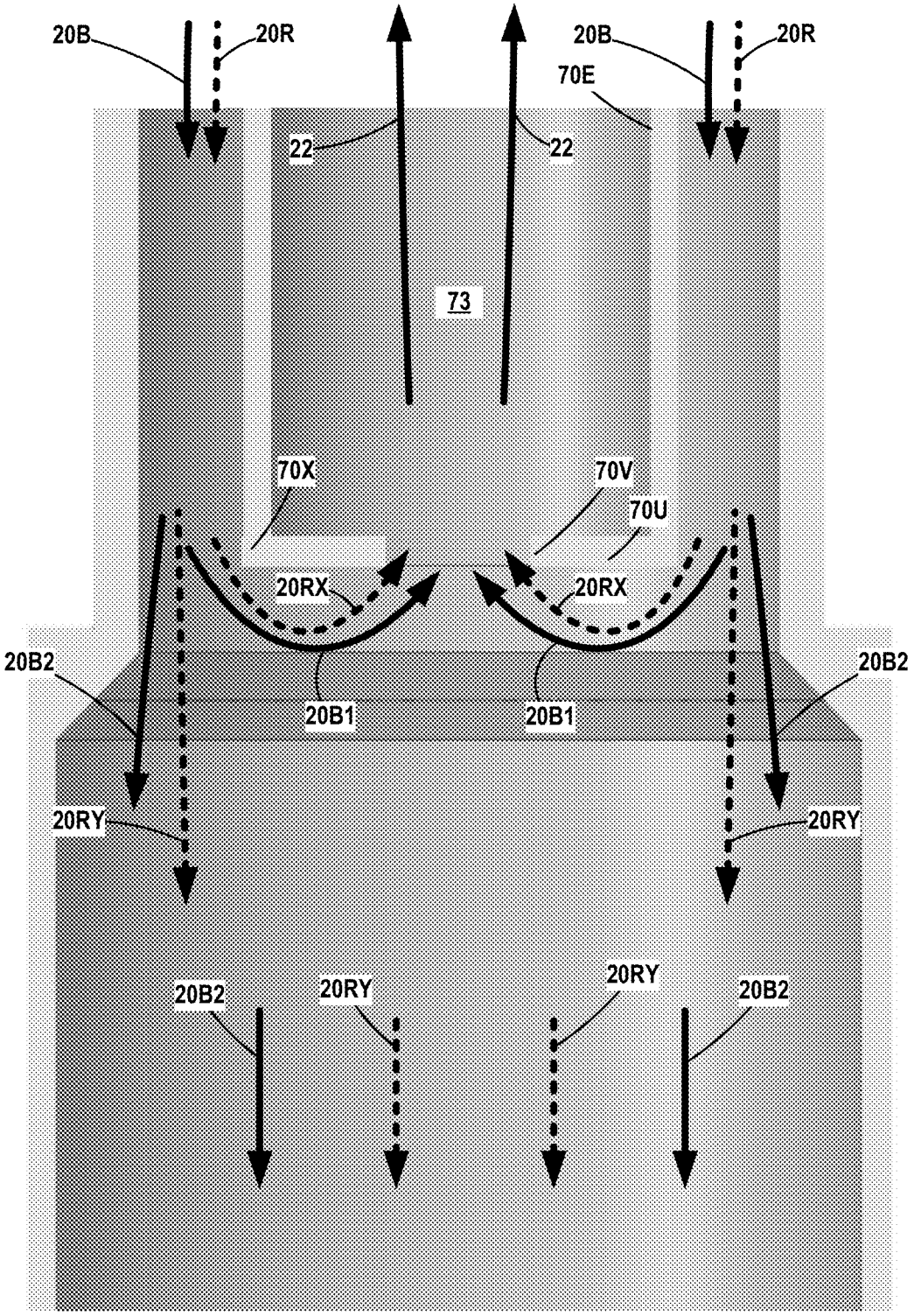

FIG. 27 depicts an embodiment of the separator wherein the fluid flow entrance 70Y into the internal flow path 73 is defined by a simple circular opening in the bottom of the lower cylindrical section 70E of the flow element 70 in the inner body 72. FIG. 28 depicts an embodiment of the separator wherein the fluid flow entrance 70Y into the internal flow path 73 is defined by a simple circular opening in a conical section 70F attached to the bottom of the lower cylindrical section 70E of the inner body 72. FIG. 29 depicts an embodiment of the separator wherein the lower cylindrical section 70E of the inner body 72 includes a closed bottom 70U, and wherein the fluid flow entrance 70Y is defined by a plurality of the above-described openings 82 that are formed in the sidewall of the lower cylindrical section 70E. FIG. 30 depicts an embodiment of the separator wherein the lower cylindrical section 70E of the inner body 72 includes a bottom 70U with a flow opening 70V formed therein and wherein the fluid flow entrance 70Y is defined by the opening 70V.

As will be appreciated by those skilled in the art after a complete reading of the present application, the cyclone separators disclosed herein may provide significant benefits as compared to at least some prior art separators. For example, in the specific example depicted above, the cyclone separator 10 comprises a substantially unrestricted bottom opening 26X that will tend to prevent any undesired accumulation of solid particles after they are removed from the incoming solids-containing fluid steam, as was the case with at least some prior art separators. Additionally, particles removed from the fluid stream by passing through the vanes 74 are not trapped within the separator, thereby tending to reduce erosion of components of the separator and reduce the likelihood of the undesirable carry over of the particles to the final cleaned fluid 22. The inclusion of the re-entrant fluid flow channel 76 and the re-entrant fluid opening 78 provides an effective means of allowing particles to flow from the bottom 26X of the cyclone separator 10 towards the solids accumulation chamber 60 without being hindered by any significant amount of adverse upward fluid flow from the accumulation chamber 60 into the outer body 26 of the separator 10. The collective volume of the solid particles that enter the accumulation chamber 60 through the bottom 26X of the cyclone separator 10 expels an equal amount of fluid volume from the accumulation chamber 60. In at least some prior art separators, the fluid expelled from the accumulation section of the vessel can only flow back up through the cyclone bottom outlet, which hinders/prevents the previously-separated solid particles trying to enter the accumulation chamber 60. Because of the re-entrant fluid flow channels 76, the fluid in the accumulation chamber 60 that is displaced by the separated particles falling into the accumulation chamber can leave the accumulator chamber 60 through the re-entrant fluid opening(s) 78 without hindering the downward flow of previously-separated solid particles entry into the accumulator chamber 60. The fluid that flows through the re-entrant fluid opening 78 and into the re-entrant fluid flow channel 76 may or may not contain some solid particles. If the fluid that flows through the re-entrant fluid opening 78 and into the re-entrant fluid flow channel 76 does contain solid particles, these entrained solid particles will be subject to the centrifugal forces once they enter the fluid flow 20RX and remain near the cyclone outer wall 26S to once again exit the cyclone through the bottom outlet 26X and end up back in the accumulator chamber 60.

As will be appreciated by those skilled in the art after a complete reading of the present application, the size, shape and configuration of the re-entrant fluid flow channel 76 may vary depending upon the particular application. For example, the re-entrant fluid flow channel 76, when viewed in cross-section, may have a substantially rectangular-shaped configuration or a substantially circular-shaped configuration (not shown). In other cases, the re-entrant fluid flow channel 76 may be partially defined by opposing sidewalls and a curved bottom surface (not shown). Additionally, the size of the re-entrant fluid flow channel 76 may change along its axial length or the size of the re-entrant fluid flow channel 76 may be substantially constant along its axial length. In some applications, the outer surface 72S of the inner body 72 may define at least a portion of the bottom of the re-entrant fluid flow channel 76 along at least some extent of the axial length of the re-entrant fluid flow channel 76. As will also be appreciated by those skilled in the art after a complete reading of the present application, the relative sizes of the nominal vane fluid flow path 99 and the vane exit fluid flow path 99A may be adjusted to increase or decrease the velocity of the fluid 20A as it exits the vane exit fluid flow path 99A so as to increase or decrease the pressure in the low-pressure region 101 proximate the exit 74X of the re-entrant fluid flow channel 76. Such engineering permits a designer to establish a desired pressure differential between the re-entrant fluid opening 78 and the exit 74X of the re-entrant fluid flow channel 76, thereby establishing the velocity and quantity of the re-entrant fluid 20R that flows through the re-entrant fluid flow channel 76.

In general, the re-entrant fluid flow channel 76 comprises an axial length and a re-entrant fluid cross-sectional flow area (not labeled). In some embodiments, the size of the re-entrant fluid cross-sectional flow area may be substantially constant along an entirety of the axial length of the re-entrant fluid flow channel 76. In other embodiments, the size of the re-entrant fluid cross-sectional flow area may be different at different locations along the axial length of the re-entrant fluid flow channel 76. Similarly, the nominal vane fluid flow path 99 (located at a position immediately upstream of the re-entrant fluid opening 78) has a first cross-sectional flow area while the vane exit fluid flow path 99A has a second cross-sectional flow area. In some embodiments, the first and second cross-sectional areas of the flow paths 99, 99A may be substantially the same. In other embodiments, the first and second cross-sectional areas of the flow paths 99, 99A may be intentionally designed to be significantly different from one another.

Figure 10:
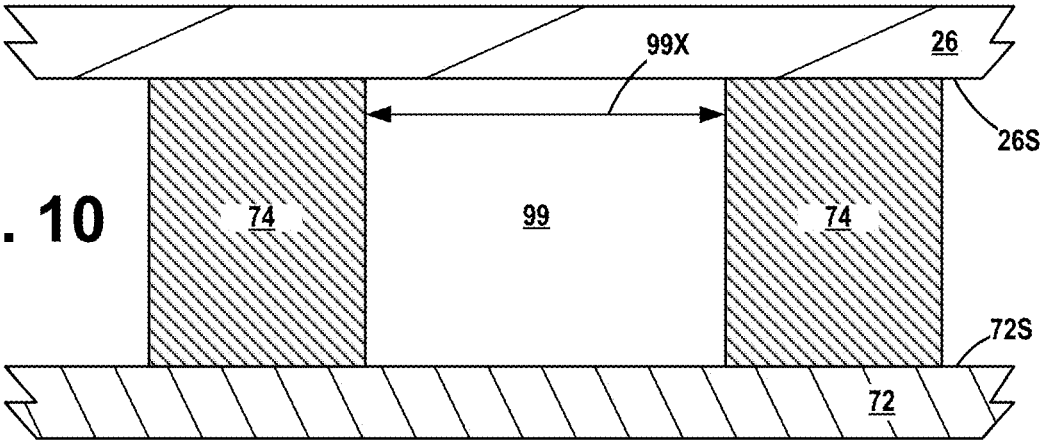
Figure 11:
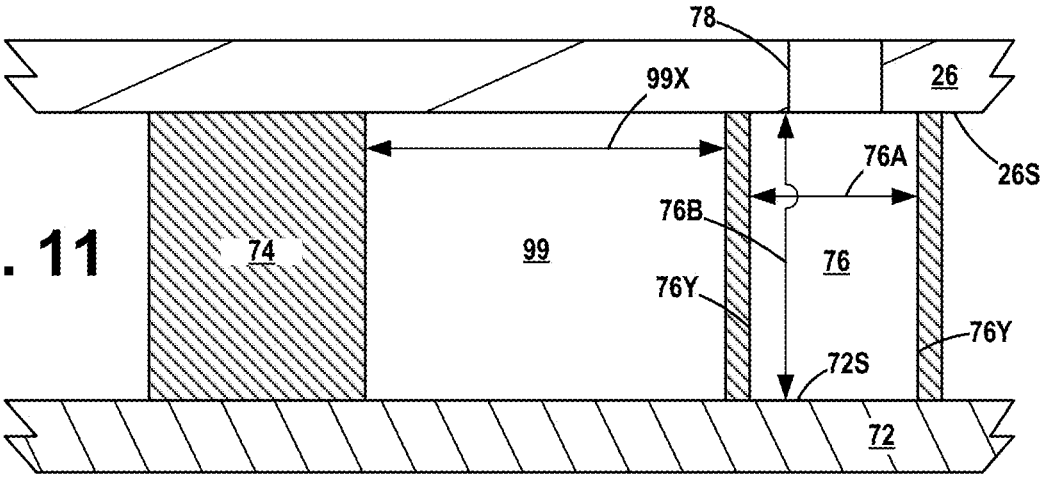

FIGS. 10 through 16 are simplistic cross-sectional views that depict some possible embodiments of the re-entrant fluid flow channel 76 and the relative sizes of the fluid flow paths 99, 99A. In these drawings, the re-entrant fluid flow channel 76 will be depicted as having a substantially rectangular configuration. FIG. 10 is a cross-sectional view of two adjacent vanes 74 at a location upstream of the re-entrant fluid opening 78 (see FIG. 11) that is in fluid communication with the re-entrant fluid flow channel 76. The nominal vane fluid flow path 99 (with a width 99X) between the vanes 74 is also depicted in FIG. 10. FIG. 11 is a cross-sectional view of the two adjacent vanes 74 at the location where the re-entrant fluid opening 78 intersects the re-entrant fluid flow channel 76. In general, the size (e.g., diameter or width) of the re-entrant fluid opening 78 may be equal to, greater than or less than the size (e.g., width) of the portion of the re-entrant fluid flow channel 76 that it intersects. In some applications, the system may be designed such that more than one re-entrant fluid opening 78 intersects with a single re-entrant fluid flow channel 76. The re-entrant fluid opening 78 may be of any size, shape or configuration, e.g., circular, elliptical, oval, rectangular, etc.

In the example depicted in FIG. 11, the re-entrant fluid flow channel 76 is sized such that it has a substantially constant width 76A and a substantially constant depth 76B along its entire axial length. Thus, in this example, the outer surface 72S of the inner body 72 defines the bottom of the re-entrant fluid flow channel 76 along its entire axial length. Accordingly, in this example, the re-entrant fluid flow channel 76 is defined by the space between the sidewalls 76Y, the outer wall 26S of the outer body 26 of the fluid separation assembly 24 and the outer surface 72S of the inner body 72. In the embodiment shown in FIG. 11, the lateral width 99X of the opening 99 has not changed from the size shown in FIG. 10.

Figure 12:
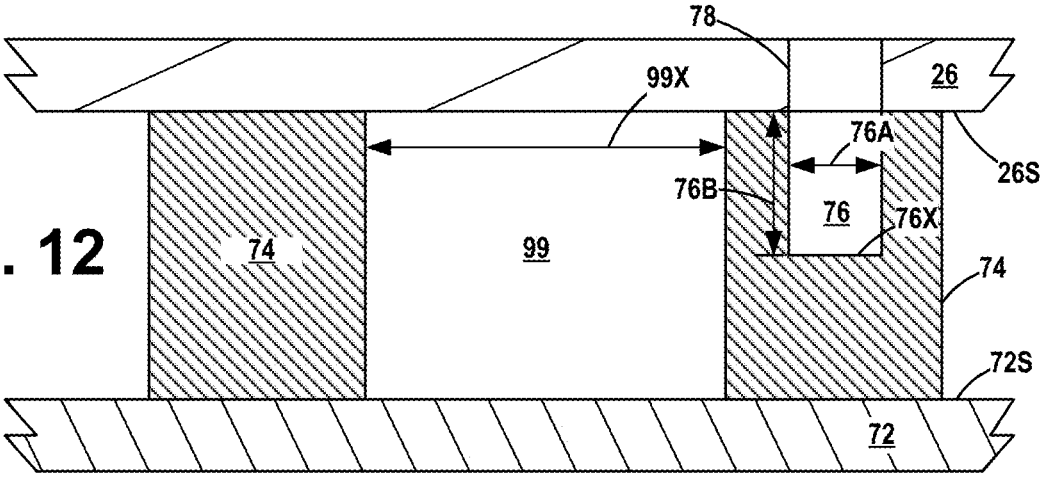

FIG. 12 is a cross-sectional view of another embodiment of a re-entrant fluid flow channel 76 at the location where the re-entrant fluid opening 78 opens into the re-entrant fluid flow channel 76. In this example, the re-entrant fluid flow channel 76 is sized such that its depth 76B increases along its axial length, e.g., the depth 76B increases along its axial length as one traverses in the downstream direction, but it has a substantially constant width 76A along its entire axial length. In some applications, the bottom of the re-entrant fluid flow channel 76 may be an angled surface, a tapered surface, a stepped configuration or a combination of any of the forgoing. Accordingly, at the location depicted in FIG. 12, the re-entrant fluid flow channel 76 has a bottom surface 76X that does not expose the surface 72S at this particular location. Additionally, in the example depicted in FIG. 12, the lateral width 99X of the flow path 99 remains the same as that shown in FIG. 10.

Figure 13:
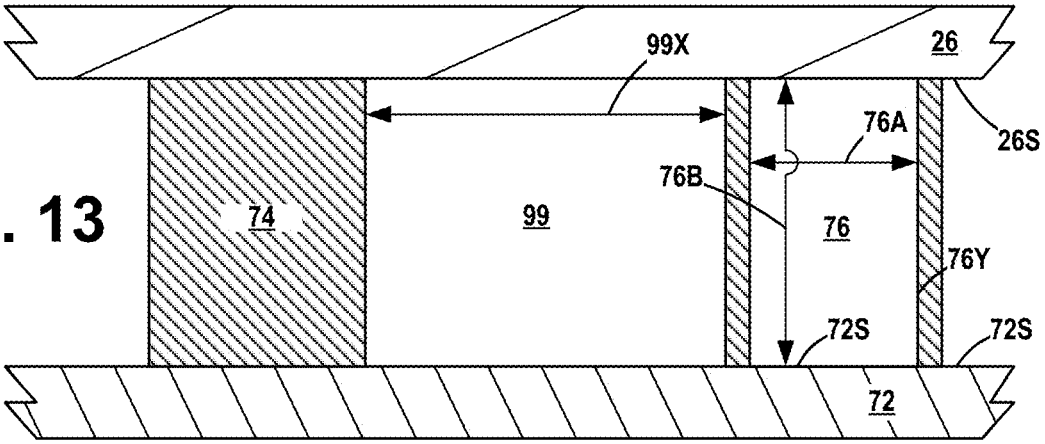

FIG. 13 depicts the embodiment of the re-entrant fluid flow channel 76 shown in FIG. 11 at some point along the axial length of the re-entrant fluid flow channel 76 between the re-entrant fluid opening 78 and the exit 74X of the re-entrant fluid flow channel 76. Note that, in this example, the width 99X of the flow path 99 remains unchanged from that shown in FIG. 10.

Figure 14:
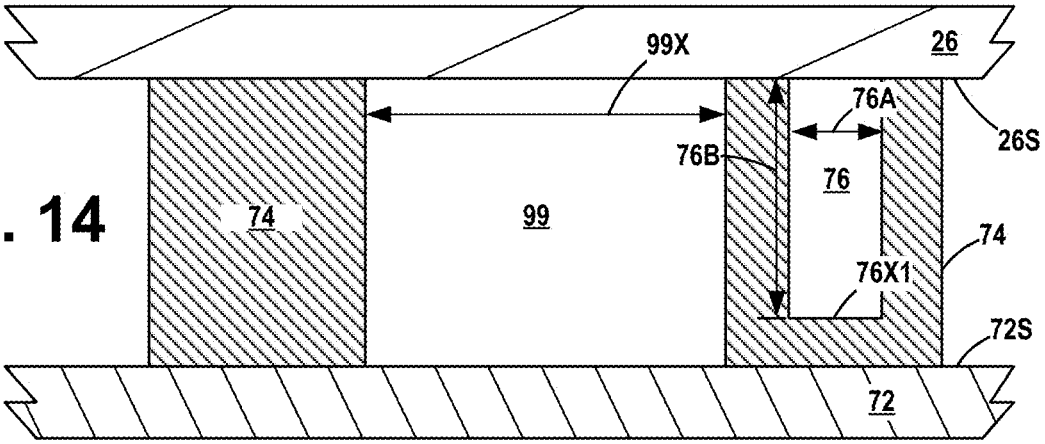

FIG. 14 depicts the embodiment of the re-entrant fluid flow channel 76 shown in FIG. 12 at some point along the axial length of the re-entrant fluid flow channel 76 between the re-entrant fluid opening 78 and the exit 74X of the re-entrant fluid flow channel 76. As shown in FIG. 14, the depth 76B of the re-entrant fluid flow channel 76 has been increased as the depth of the bottom surface 76X1 is greater than the depth of the bottom surface 76X (see FIG. 12). At the location shown in FIG. 14, the surface 72S of the inner body 72 is still not exposed by the re-entrant fluid flow channel 76. Note that, in this example, the width 99X of the flow path 99 also remains unchanged from that shown in FIG. 10.

Figure 15:
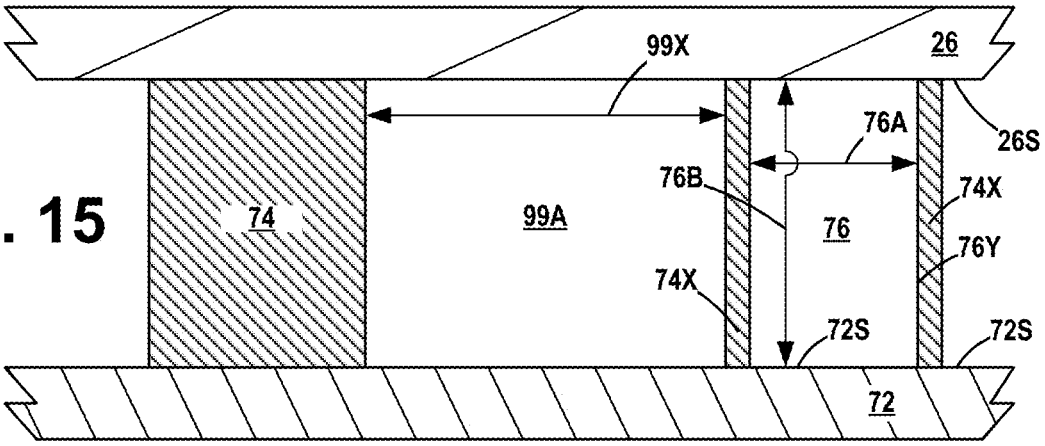

FIG. 15 depicts the embodiment of the re-entrant fluid flow channel 76 shown in FIGS. 11 and 13 at the exit 74X of the re-entrant fluid flow channel 76. Also depicted in this drawing is the vane exit flow path 99A proximate the end 74X of the re-entrant fluid flow channel 76. Note that, in this example, the vane exit flow path 99A has a width that is substantially equal to the width 99X of the flow path 99 at the location shown in FIG. 10.

Figure 16:
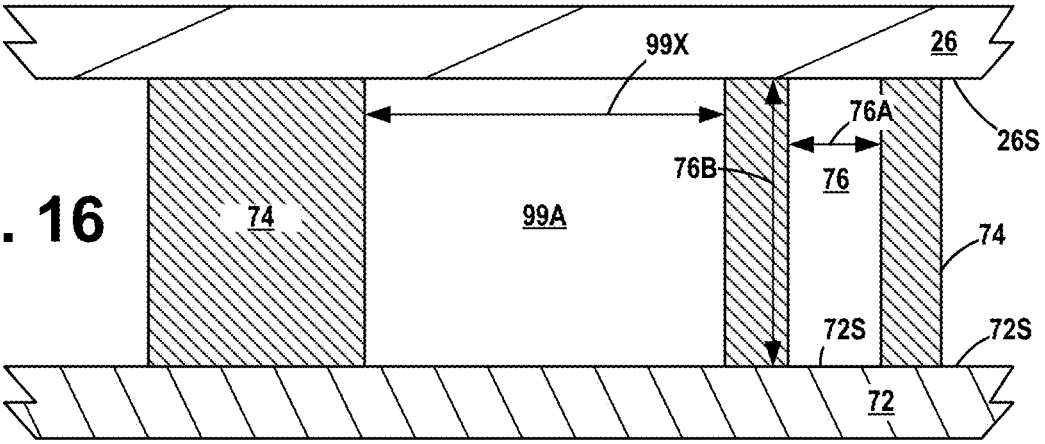

FIG. 16 depicts the embodiment of the re-entrant fluid flow channel 76 shown in FIGS. 12 and 14 at the exit 74X of the re-entrant fluid flow channel 76. The vane exit fluid flow path 99A is also depicted in FIG. 16. As shown in FIG. 16, the depth 76B of the re-entrant fluid flow channel 76 has been increased such that the outer surface 72S of the inner body 72 is exposed at the exit 74X. However, in some cases, the re-entrant fluid flow channel 76 may be sized such that the outer surface 72S is not exposed at any location along the axial length of the re-entrant fluid flow channel 76. Note that, in this example, the width 99X of the flow path 99A also remains unchanged from that shown in FIG. 10, i.e., the size of the flow paths 99, 99A are substantially the same.

FIGS. 17 through 21 are simplistic cross-sectional views that depict an embodiment wherein the re-entrant fluid flow channel 76 is sized such that it has a substantially constant depth 76B along its entire axial length, but its width 76A increases along its axial length, e.g., the width 76A increases along its axial length as one traverses in the downstream direction. Also, in this example, the lateral dimension (e.g., width) of the flow path 99 decreases along its axial length as one traverses in the downstream direction.

Figure 17:
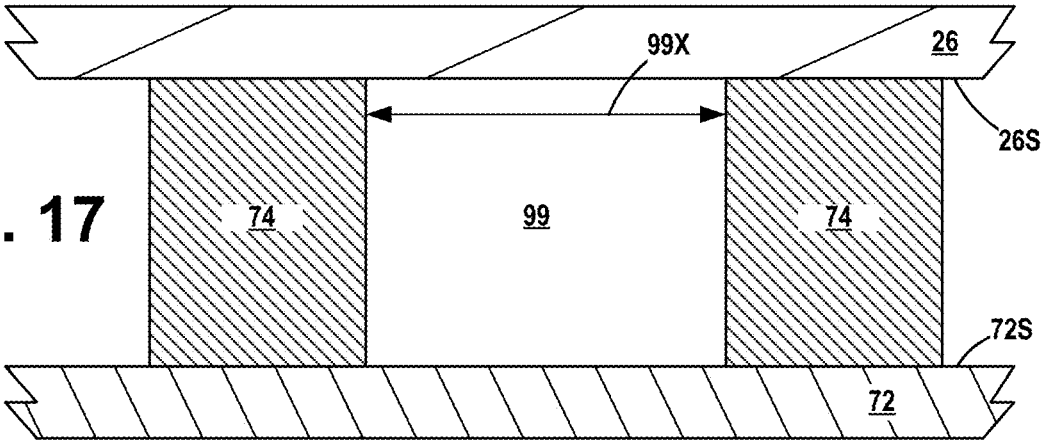

Accordingly, FIG. 17 is a cross-sectional view of the two adjacent vanes 74 at a location upstream of the re-entrant fluid opening 78. The nominal vane fluid flow path 99 (with a width 99X) between the vanes 74 is also depicted in FIG. 17.

Figure 18:
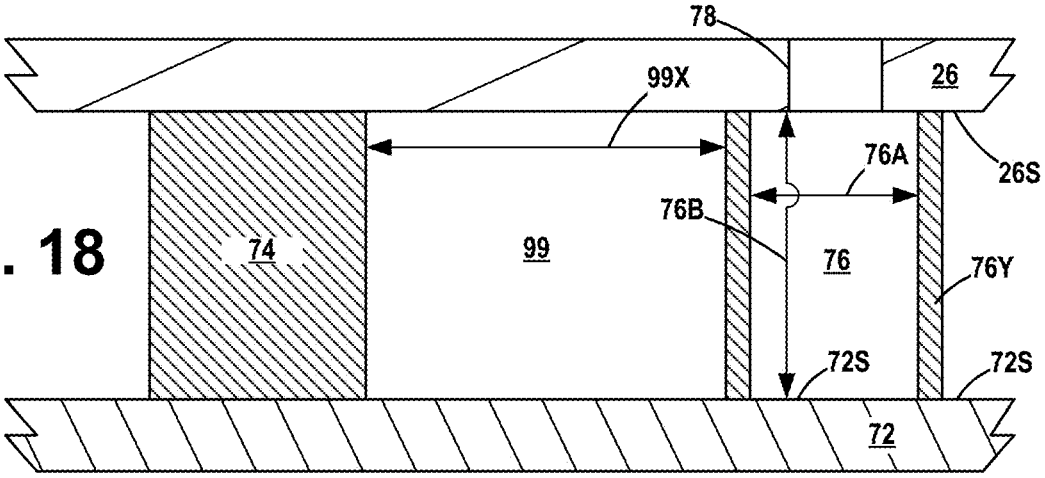

FIG. 18 is a cross-sectional view of the two adjacent vanes 74 at the location where the re-entrant fluid opening 78 intersects the re-entrant fluid flow channel 76. At this location, the width 99X of the flow path 99 remains unchanged, and the re-entrant fluid channel 76 has a width 76A.

Figure 19:
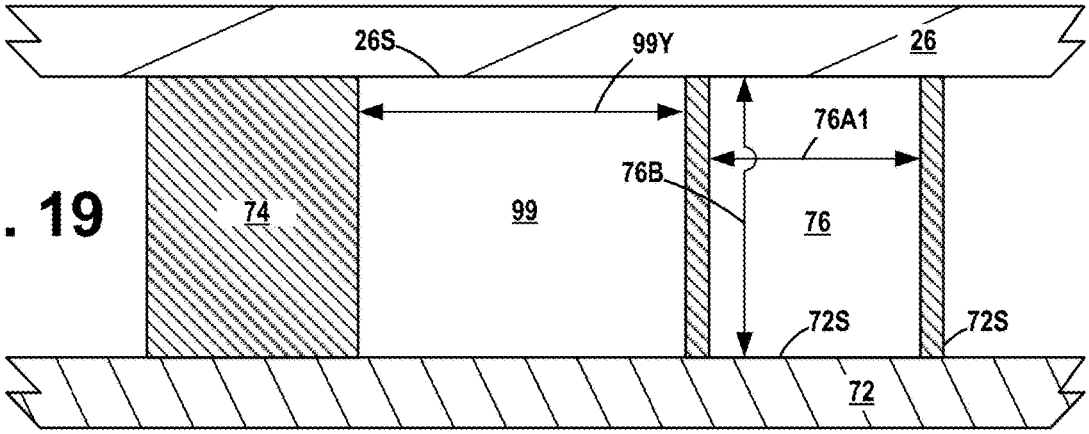

FIG. 19 is a cross-sectional view of the re-entrant fluid flow channel 76 at some point along the axial length of the re-entrant fluid flow channel 76 between the re-entrant fluid opening 78 and the exit 74X of the re-entrant fluid flow channel 76. At this location, the flow path 99 now has a width 99Y that is less than the width 99X of the flow path 99 at the location shown in FIG. 18. Also note that, at this location, the re-entrant fluid channel 76 has a width 76A1 that is greater than the width 76A at the location shown in FIG. 18.

Figure 20:
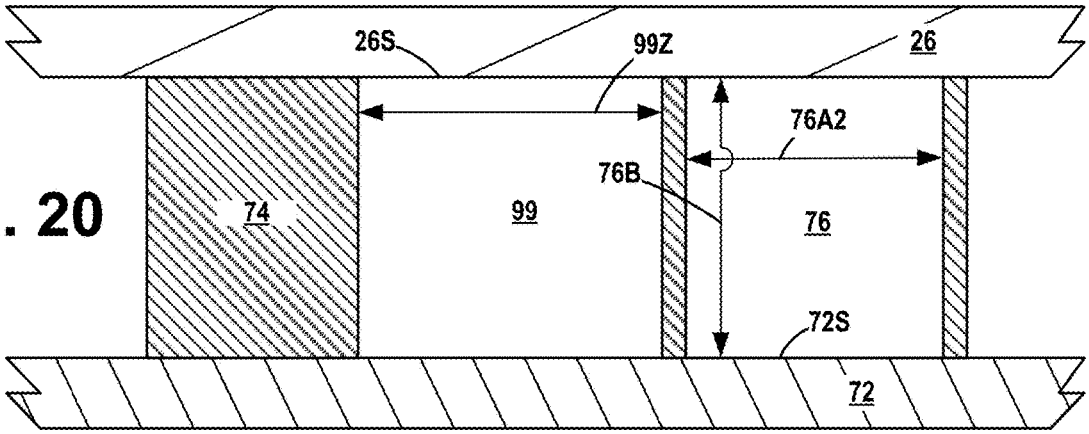

FIG. 20 is a cross-sectional view of the re-entrant fluid flow channel 76 at some point along the axial length of the re-entrant fluid flow channel 76 downstream of the view shown in FIG. 19 but upstream of the exit 74X of the re-entrant fluid flow channel 76. At this location, the flow path 99 now has a width 99Z that is less than the width 99Y of the flow path 99 at the location shown in FIG. 19. Also note that, at this location, the re-entrant fluid channel 76 has a width 76A2 that is greater than the width 76A1 at the location shown in FIG. 19.

Figure 21:
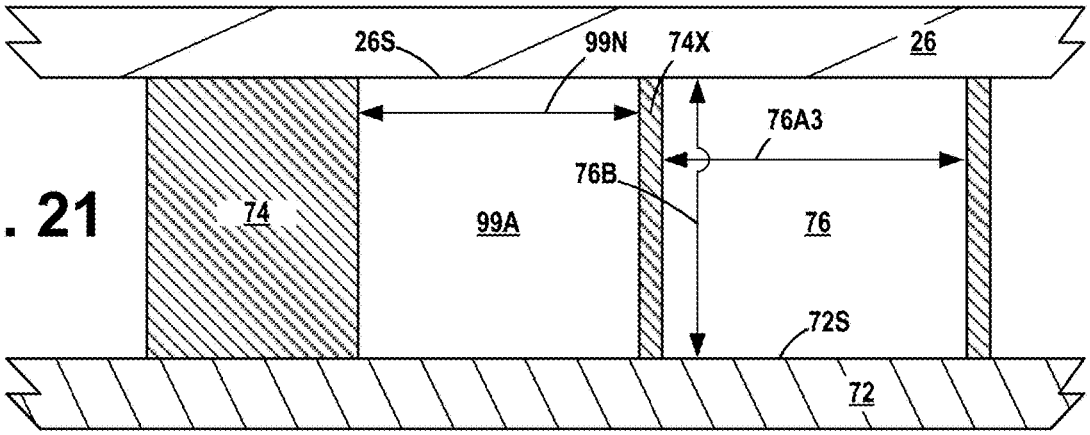

FIG. 21 is a cross-sectional view of the re-entrant fluid flow channel 76 at the exit 74X of the re-entrant fluid flow channel 76. The vane exit fluid flow path 99A is also depicted in FIG. 21. At this location, the flow path 99A now has a width 99N that is less than the width 99Z of the flow path 99 at the location shown in FIG. 20. Also note that, at this location, the re-entrant fluid channel 76 has a width 76A3 that is greater than the width 76A2 at the location shown in FIG. 20. Note that, in this example, the width 99N of the flow path 99A is less than the original width 99X of the nominal vane fluid flow path 99 at the location shown in FIG. 17.

FIGS. 22 through 26 are simplistic cross-sectional views that depict an embodiment wherein the re-entrant fluid flow channel 76 is sized such that it has a substantially constant width 76A and a substantially constant depth 76B along its entire axial length. Also, in this example, the lateral dimension (e.g., width) of the flow path 99 decreases along its axial length as one traverses in the downstream direction, but the reduction of the width of the flow path 99 is accomplished by changing the thickness of the sidewalls 76Y of the re-entrant fluid flow channel 76 as one traverses in the downstream direction.

Figure 22:
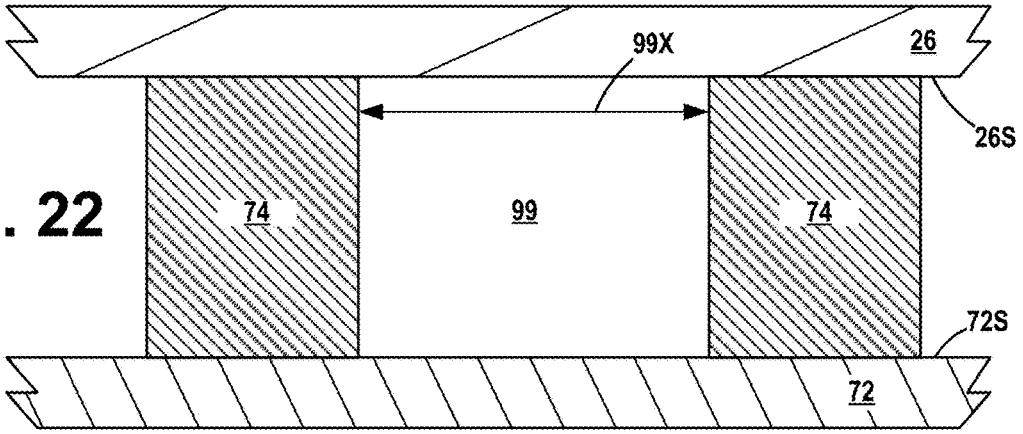

Accordingly, FIG. 22 is a cross-sectional view of the two adjacent vanes 74 at a location upstream of the re-entrant fluid opening 78. The nominal vane fluid flow path 99 (with a width 99X) between the vanes 74 is also depicted in FIG. 22.

Figure 23:
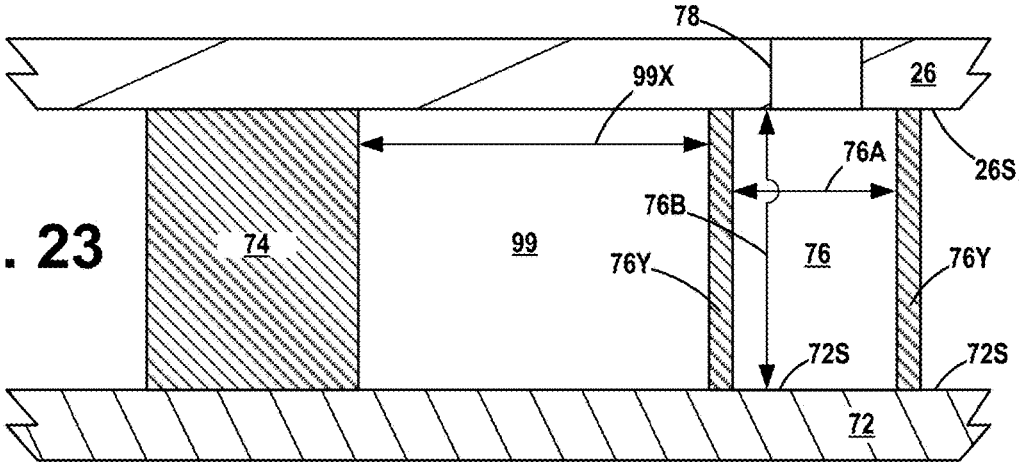

FIG. 23 is a cross-sectional view of the two adjacent vanes 74 at the location where the re-entrant fluid opening 78 intersects the re-entrant fluid flow channel 76. At this location, the width 99X of the flow path 99 remains unchanged, and the sidewalls 76Y of the re-entrant fluid flow channel 76 have an initial lateral thickness.

Figure 24:
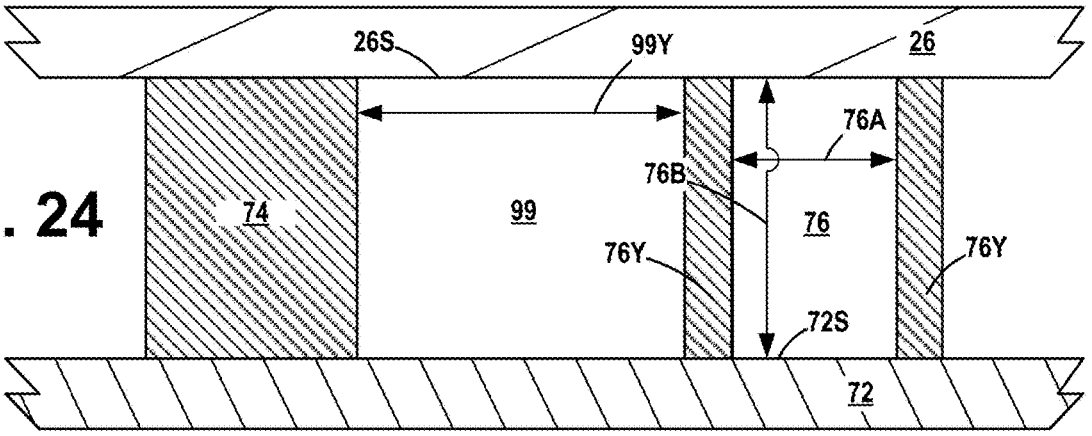

FIG. 24 is a cross-sectional view of the re-entrant fluid flow channel 76 at some point along the axial length of the re-entrant fluid flow channel 76 between the re-entrant fluid opening 78 and the exit 74X of the re-entrant fluid flow channel 76. At this location, the flow path 99 now has a width 99Y that is less than the width 99X of the flow path 99 at the location shown in FIG. 23. However, at this location, the lateral thickness of the sidewalls 76Y has been increased relative to the initial thickness of the sidewalls 76Y at the location shown in FIG. 23.

Figure 25:
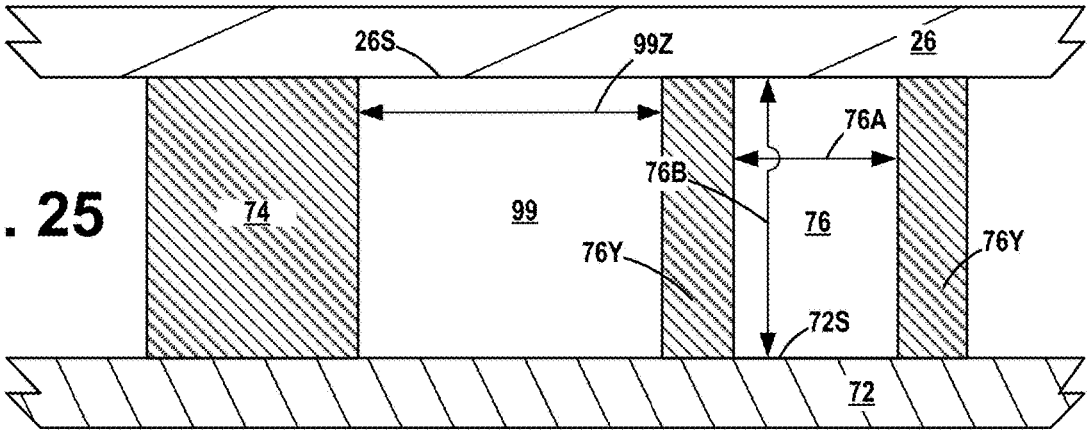

FIG. 25 is a cross-sectional view of the re-entrant fluid flow channel 76 at some point along the axial length of the re-entrant fluid flow channel 76 downstream of the view shown in FIG. 24 but upstream of the exit 74X of the re-entrant fluid flow channel 76. At this location, the flow path 99 now has a width 99Z that is less than the width 99Y of the flow path 99 at the location shown in FIG. 24. Also note that, at this location, the lateral thickness of the sidewalls 76Y has been increased relative to the thickness of the sidewalls 76Y at the location shown in FIG. 24.

Figure 26:
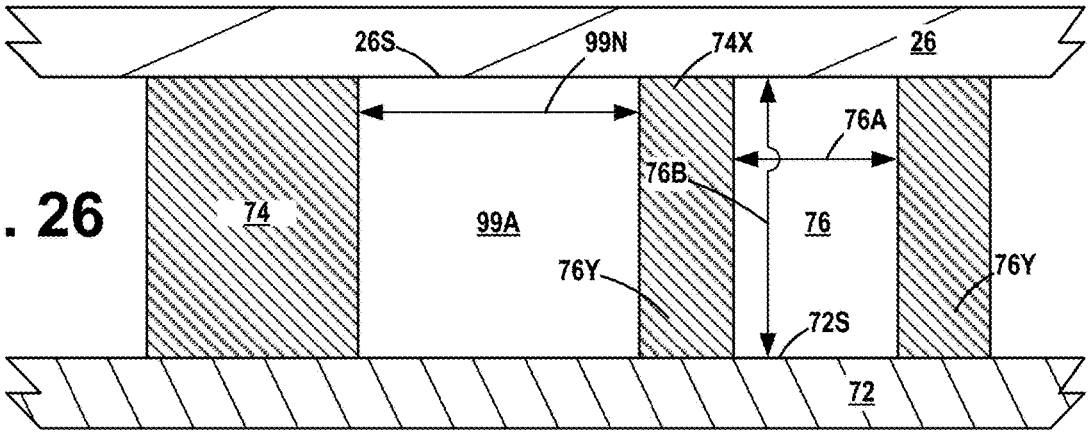

FIG. 26 is a cross-sectional view of the re-entrant fluid flow channel 76 at the exit 74X of the re-entrant fluid flow channel 76. The vane exit fluid flow path 99A is also depicted in FIG. 26. At this location, the flow path 99A now has a width 99N that is less than the width 99Z of the flow path 99 at the location shown in FIG. 25. Also note that, at this location, the lateral thickness of the sidewalls 76Y has been increased relative to the thickness of the sidewalls 76Y at the location shown in FIG. 25. Note that, in this example, the width 99N of the flow path 99A is less than the original width 99X of the nominal vane fluid flow path 99 at the location shown in FIG. 22.

After a complete reading of the present application, those skilled in the art will appreciate that there are several novel devices, methods and systems disclosed herein. For example, a method disclosed herein includes taking some portion of the fluid 20C (see FIG. 6) that has exited the body 26 of the separator 10 and re-introducing that portion of the fluid 20C back into the overall system at a point upstream of the fluid flow entrance 70Y to the internal flow path 73 in the inner body 72 of the separator 10. In the previously discussed example, the re-introduced fluid 20C is re-introduced into the system via the re-entrant fluid openings 78 that extend through the outer body 26. As noted above, each of the re-entrant fluid openings 78 is in fluid communication with a re-entrant fluid flow channel 76 that is formed in one of the vanes 74.

Figure 31:
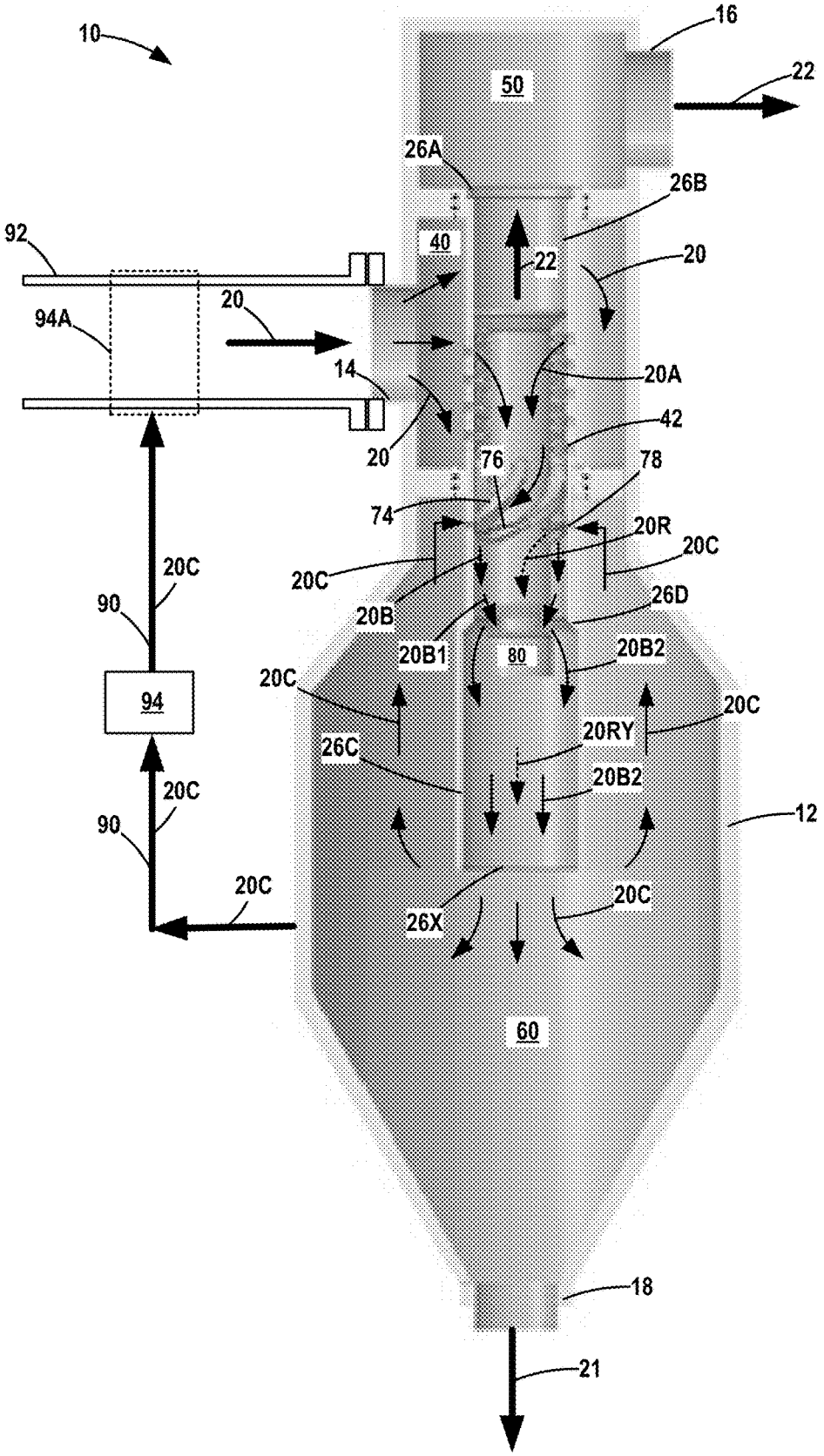

In another embodiment, as shown in FIG. 31, a portion the fluid 20C is re-introduced into the system at a point upstream of the fluid flow entrance 70Y to the internal flow path 73 in the inner body 72 of the separator by directing a portion of the fluid 20 into the entering fluid stream 20 that will flow into the separator 10. For example, the system may include a fluid flow path 90 (e.g., piping (not shown)) that establishes fluid communication between the vessel 12 (e.g., the accumulation section 60) and fluid inlet piping 92 that is coupled to the fluid inlet 14. A schematically depicted motive fluid device 94 is positioned so as to be in fluid communication with the flow path 90 and drive the fluid 20C from the vessel 12 into the incoming stream 20. The motive fluid device 94 may take a variety of forms depending upon the composition (e.g., liquid and/or gas) of the fluid 20C. For example, the motive fluid device 94 may comprise a pump, an eductor, a fan, a compressor, etc. The motive fluid device 94 may also take the form of an eductor (that is schematically depicted as a dashed line box 94A), where the incoming fluid stream 20 is used to effectively draw the fluid stream 20C from the vessel into the fluid inlet piping 92.

Figure 32:
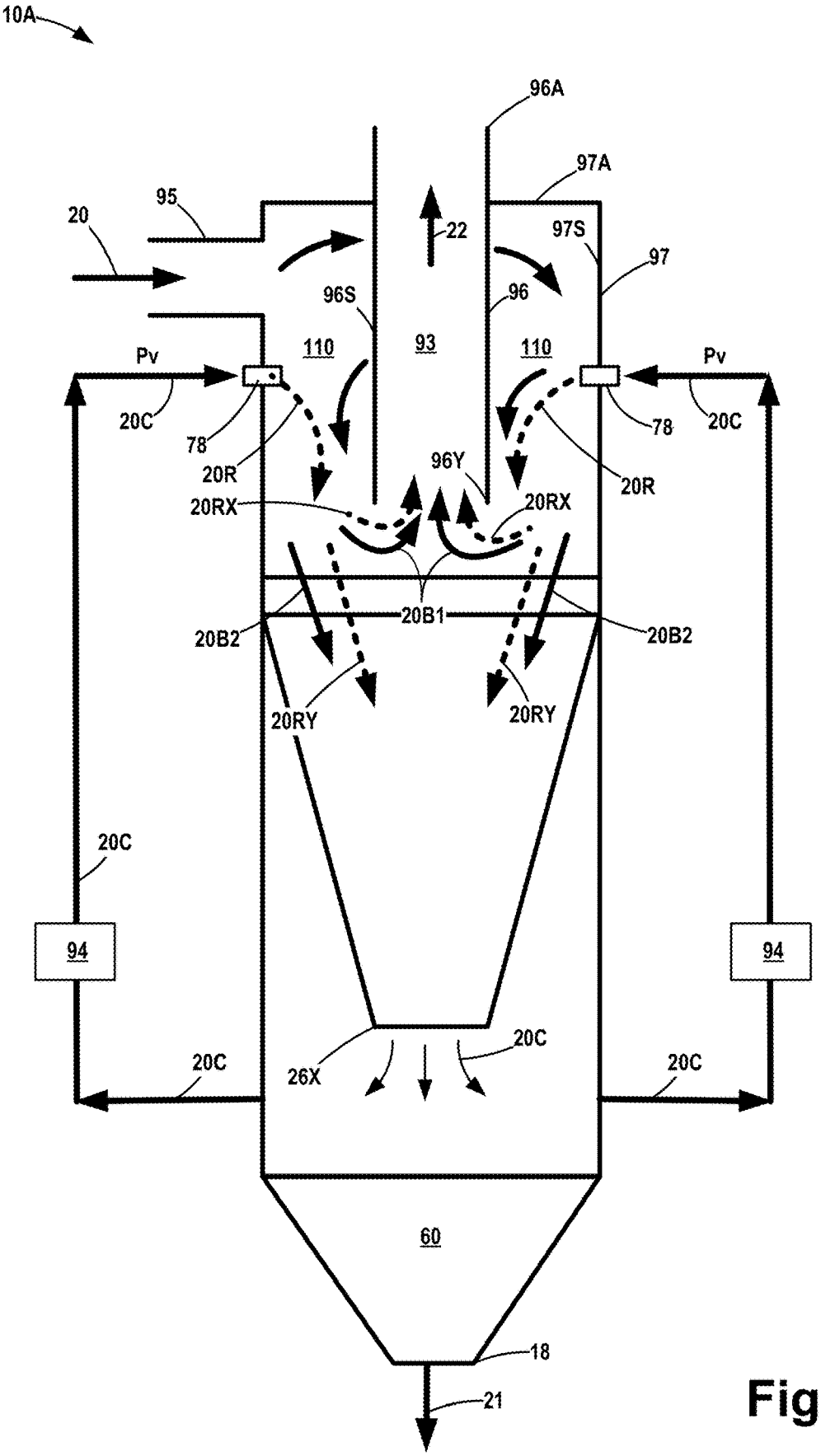
Figure 33:
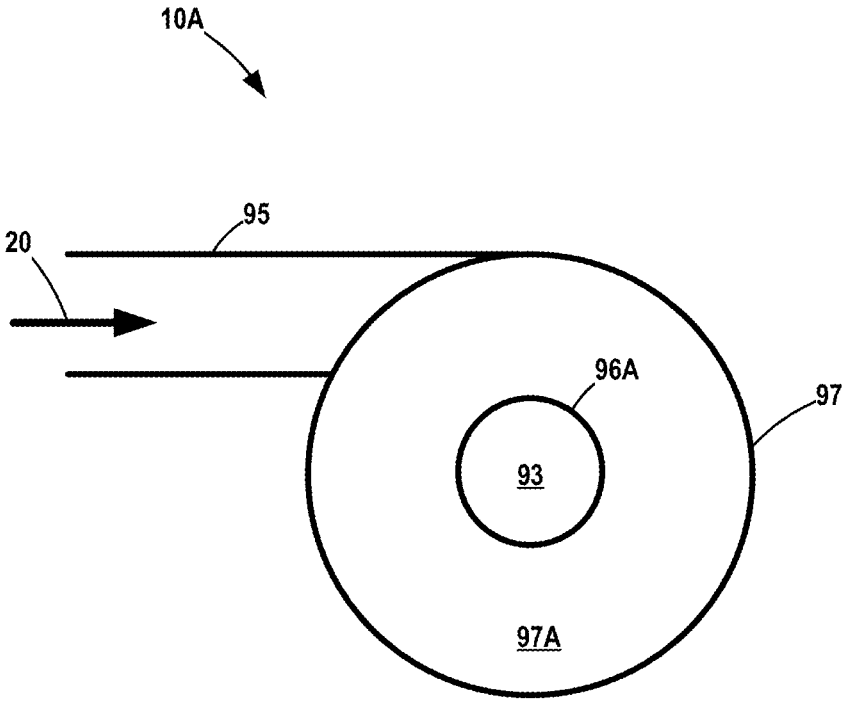

In yet another embodiment and with reference to FIGS. 32 and 33, the methods disclosed herein may be used on a cyclone separator 10A that does not include the above-described vanes 74. FIG. 33 is a top view of this embodiment of the separator 10A. Of course, if desired, with certain routine modifications, this type of separator 10A may also be positioned in a larger vessel, such as the vessel 12 depicted above. In this example, the separator 10A comprises an inner body 96 that is positioned at least partially within and extends through an upper surface 97A of an outer body 97. In this embodiment, the separator 10A also includes a fluid inlet 95 that is positioned tangentially with regards to the outer body 97. The inner body 96 comprises a cleaned fluid outlet 96A (that corresponds to the above-described cleaned fluid outlet 70A), a fluid flow entrance 96Y (that corresponds to the above-described fluid flow entrance 70Y) and an internal flow path 93 (that corresponds to the above-described internal flow path 73). In this embodiment, a fluid flow path 110 is defined between an inner surface 97S of the outer body 97 and an outer surface 96S of the inner body 96. In this embodiment, as noted above, the fluid flow path 110 is a substantially unobstructed annular-shaped flow path that is free of any of the vanes described in the previous embodiment. In this embodiment, the separator 10A also includes one or more of the re-entrant fluid openings 78 that extend through the outer body 97. As with the previous embodiment, the re-entrant fluid openings 78 are positioned in the body 97 at a point upstream of the fluid flow entrance 96Y to the internal flow path 93 in the inner body 96. As depicted, the re-entrant fluid openings 78 are in fluid communication with the fluid flow path 110. In this example, the above-described re-introduced fluid 20C is re-introduced into the system via the re-entrant fluid openings 78 that extend through the outer body 97.

In terms of operation, the separator 10A operates in substantially the same manner as the previous embodiment. Incoming fluid 20, with entrained solids therein, enters separator 10A via the tangentially oriented fluid inlet 95 where it flows into the annular shaped fluid flow path 110 between the inner surface 97S of the outer body 97 and the outer surface 96S of the inner body 96 and begins to rotate. As this rotating stream of fluid is forced downward through the fluid flow path 110, solid particulate matter and liquid within the fluid is forced radially outward against the inner surface 97S (i.e., the outer wall) of the cyclone separator 10A. These expelled solid particles and fluids fall out though the bottom 26X of the cyclone separator 10A and into the solids accumulation chamber 60.

At that point, a now relatively cleaner fluid—now referenced using the numeral 20B—exits the fluid flow path 110. The fluid 20B travels further downward within the cyclone separator 10A until such time as a first portion 20B1 of the fluid 20B enters into the fluid flow entrance 96Y of the inner body 96. A second portion 20B2 of the fluid 20B bypasses the fluid flow entrance 96Y and flows out of the bottom 26X of the cyclone separator 10A and into the solids accumulation chamber 60. All of the fluids exiting the bottom 26X of the cyclone separator 10A and flowing into the solids accumulation chamber 60 are referenced using the designation 20C.

In some applications, one nor more of the above-described motive fluid devices 94 may be provided to force or re-direct a portion of the fluid 20C within the solids accumulation chamber 60 to the re-entrant fluid openings 78. This re-entrant fluid is designated with the dashed line arrow labeled 20R at a point where it exits the re-entrant fluid openings 78 and is introduced into the fluid flow path 110. With continued reference to FIG. 32, as the re-entrant fluid 20R exits the fluid flow path 110, it will travel further downward within the cyclone separator 10A until such time as a first portion 20RX of the re-entrant fluid 20R enters into the inner body 96 (via the fluid flow entrance 96Y). A second portion 2ORY of the re-entrant fluid 20R bypasses the inner body and flows out of the bottom 26X of the cyclone separator 10A and into the solids accumulation chamber 60. As noted above, all of the fluid exiting the bottom 26X of the cyclone separator 10, including the second portion 2ORY of the re-entrant fluid 20R that flows into the solids accumulation chamber 60, is referenced using the designation 20C. The fluid streams 20B1 and 20RX pass through the fluid flow entrance 96Y in the inner body 96 where they combine to form the cleaned fluid stream 22 that flows out of the fluid outlet 96A. Any solids 21 that fall to the bottom of the solids accumulation chamber 60 may be removed via the solids outlet 18. Additionally, if desired, the fluid 20C can be redirected to the fluid 20 entering the tangentially oriented inlet 95 using the method and techniques described above in connection with FIG. 31, e.g., by use of one or more additional motive fluid devices 94 and/or an eductor 94A.

As will be appreciated by those skilled in the art after a complete reading of the present application various novel separator designs and methods are disclosed herein. For example, various embodiments of a cyclone separator 10, 10A disclosed herein may comprise an outer body with an inner surface and an inner body positioned at least partially within the outer body The inner body comprises an outer surface and an internal flow path within the inner body, wherein the internal flow path has a fluid entrance and a fluid outlet. The separator also includes a first fluid flow channel between the inner body and the outer body and a re-entrant fluid opening that extends through the outer body and is in fluid communication with the fluid flow channel, wherein the re-entrant fluid opening is positioned at a location upstream of the fluid entrance of the internal flow path in the inner body.

In yet another example, a cyclone separator 10 disclosed herein may comprise an outer body 26 that has an inner surface 26S and a flow rotation element 70 positioned within the outer body 26, wherein the flow rotation element 70 includes a plurality of vanes 74. In this example, a first fluid flow channel 99 is defined between each pair of adjacent vanes 74 and each vane comprises an outer surface 74A that engages the inner surface26S of the outer body 26. Furthermore, the separator may also include a re-entrant fluid flow channel 76 that is formed in at least one of the vanes 74 and a re-entrant fluid opening 78 that is in fluid communication with the re-entrant fluid flow channel 76, wherein the re-entrant fluid opening 78 extends through the outer body 26.

One illustrative method disclosed for separating a fluid stream in a cyclone separator 10, 10A that comprises an outer body and an inner body includes flowing the fluid stream through a fluid inlet of the separator 10, 10A, through a first fluid flow channel in the separator and out of a fluid exit of the outer body of the separator and re-introducing a portion of the fluid exiting the fluid exit of the outer body into the fluid stream at a location that is upstream of a fluid entrance to an internal flow path in the inner body.

The particular embodiments disclosed above are illustrative only, as the invention may be modified and practiced in different but equivalent manners apparent to those skilled in the art having the benefit of the teachings herein. For example, the method steps set forth above may be performed in a different order. Furthermore, no limitations are intended to the details of construction or design herein shown. It is therefore evident that the particular embodiments disclosed above may be altered or modified and all such variations are considered within the scope and spirit of the invention. Accordingly, the protection sought herein is as set forth in the claims below.

What is claimed:

1. A cyclone separator, comprising:

an outer body comprising an inner surface;

an inner body positioned at least partially within the outer body, the inner body comprising an outer surface and an internal flow path within the inner body, the internal flow path comprising a fluid entrance and a fluid outlet;

a first fluid flow channel between the inner body and the outer body;

a re-entrant fluid opening that extends through the outer body and is in fluid communication with the first fluid flow channel, wherein the re-entrant fluid opening is positioned at a location upstream of the fluid entrance of the internal flow path in the inner body, wherein the re-entrant fluid opening provides a flow path between a solids accumulation chamber at a bottom of the inner body and at least one re-entrant fluid flow channel of the inner body.

2. The cyclone separator of claim 1, wherein the outer body further comprises a fluid inlet that is positioned tangentially with respect to the outer body.

3. The cyclone separator of claim 2, wherein the outer surface of the inner body is a cylindrical outer surface that is free of any vanes.

4. The cyclone separator of claim 2, wherein the first fluid flow channel is an unobstructed annular flow channel bounded by the outer surface of the inner body and the inner surface of the outer body.

5. The cyclone separator of claim 1, further comprising:

a plurality of vanes positioned in the first fluid flow channel between the inner body and the outer body, wherein each vane comprises an outer surface that engages the inner surface of the outer body; and the at least one re-entrant fluid flow channel is formed in at least one of the plurality of vanes, wherein the re-entrant fluid opening is in fluid communication with the at least one re-entrant fluid flow channel.

6. The cyclone separator of claim 5, wherein the plurality of vanes are spiraling vanes.

7. The cyclone separator of claim 1, further comprising a flow rotation element positioned between the inner body and the outer body in the first fluid flow channel.

8. A cyclone separator, comprising:

an outer body comprising an inner surface;

a flow rotation element positioned within the outer body, the flow rotation element comprising first and second vanes, wherein each of the first and second vanes comprises an outer surface that engages the inner surface of the outer body;

a first fluid flow channel between the first and second vanes;

a first re-entrant fluid flow channel in at least one of the first and second vanes; and a re-entrant fluid opening that is in fluid communication with the first re-entrant fluid flow channel, wherein the re-entrant fluid opening extends through the outer body.

9. The cyclone separator of claim 8, wherein each of the first and second vanes comprise an upstream end and a downstream end, and wherein the first re-entrant fluid flow channel comprises a first re-entrant fluid exit that is substantially coterminous with the downstream end of the vane in which the first re-entrant fluid flow channel is formed.

10. The cyclone separator of claim 9, wherein the first re-entrant fluid flow channel is formed in the first vane, wherein each of the first and second vanes comprises first and second vane sidewalls, each of the first and second vane sidewalls comprising an interior surface and an exterior surface, wherein the first re-entrant fluid flow channel is partially defined by the interior surfaces of the first and second vane sidewalls of the first vane, and wherein a downstream exit of the first fluid flow channel is defined between the exterior surface of the first vane sidewall of the first vane and the exterior surface of a nearest vane sidewall of the second vane.

11. The cyclone separator of claim 10, wherein, at a position immediately upstream of a location where the re-entrant fluid opening extends through the outer body, the first fluid flow channel comprises a first cross-sectional flow area, and wherein the downstream exit of the first fluid flow channel has a second cross-sectional flow area, wherein the first cross-sectional flow area and the second cross-sectional flow area are substantially the same.

12. The cyclone separator of claim 10, wherein the re-entrant fluid opening is adapted to receive a fluid that previously passed through the downstream exit of the first fluid flow channel.

13. The cyclone separator of claim 8, wherein the first re-entrant fluid flow channel comprises an axial length and a first re-entrant fluid cross-sectional flow area, wherein a size of the first re-entrant fluid cross-sectional flow area is substantially constant along an entirety of the axial length of the first re-entrant fluid flow channel.

14. The cyclone separator of claim 8, wherein the first re-entrant fluid flow channel comprises an axial length and a first re-entrant fluid cross-sectional flow area, wherein a size of the first re-entrant fluid cross-sectional flow area is different at different locations along the axial length of the first re-entrant fluid flow channel.

15. The cyclone separator of claim 8, wherein the first re-entrant fluid flow channel comprises a first re-entrant fluid cross-sectional flow area with a cross-sectional configuration that is one of substantially rectangular or substantially circular.

16. The cyclone separator of claim 8, further comprising an inner body positioned at least partially within the outer body, the inner body comprising an outer surface, an internal flow path within the inner body, a fluid entrance to the internal flow path and a fluid outlet from the internal flow path, wherein the flow rotation element is positioned between the outer surface of the inner body and the inner surface of the outer body and wherein the re-entrant fluid opening is positioned at a location upstream of the fluid entrance of the internal flow path in the inner body.

17. A cyclone separator, comprising:

an outer body comprising an inner surface;

an inner body positioned at least partially within the outer body, the inner body comprising an outer surface, an internal flow path within the inner body, a fluid entrance to the internal flow path and a fluid outlet from the internal flow path;

a flow rotation element positioned between the outer surface of the inner body and the inner surface of the outer body, the flow rotation element comprising a plurality of vanes, wherein each of the plurality of vanes comprises an outer surface that engages the inner surface of the outer body;

a first fluid flow channel between each pair of adjacent vanes;

a first re-entrant fluid flow channel in each of the plurality of vanes; and a plurality of re-entrant fluid openings that extend through the outer body, wherein each of the re-entrant fluid openings is in fluid communication with one of the first re-entrant fluid flow channels.

18. The cyclone separator of claim 17, wherein each of the plurality of vanes comprise an upstream end and a downstream end, and wherein each of the first re-entrant fluid flow channels comprises a first re-entrant fluid exit that is substantially coterminous with the downstream end of the vane in which the first re-entrant fluid flow channel is formed.

19. The cyclone separator of claim 17, wherein each of the plurality of vanes comprises first and second vane sidewalls, each of the first and second vane sidewalls comprising an interior surface and an exterior surface, wherein the first re-entrant fluid flow channel in each of the plurality of vanes is partially defined by the interior surfaces of the first and second vane sidewalls of the vane, and wherein a downstream exit of the first fluid flow channel is defined between the exterior surface of the first vane sidewall of a first vane and the exterior surface of a nearest vane sidewall of an adjacent vane.

20. The cyclone separator of claim 17, wherein each of the re-entrant fluid openings is adapted to receive a fluid that previously passed through a downstream exit of the first fluid flow channel.

21. The cyclone separator of claim 17, wherein each the re-entrant fluid openings is positioned at a location upstream of the fluid entrance of the internal flow path in the inner body.

* * * * *